US006527016B2

(12) United States Patent
Todaro

(10) Patent No.: US 6,527,016 B2
(45) Date of Patent: Mar. 4, 2003

(54) AUTOMATED SPIRAL BINDING MACHINE

(75) Inventor: Frank Todaro, Old Saybrook, CT (US)

(73) Assignee: General Binding Corporation, Northbrook, IL (US)

( * ) Notice: Subject to any disclaimer, the term of this patent is extended or adjusted under 35 U.S.C. 154(b) by 0 days.

(21) Appl. No.: 09/795,712

(22) Filed: Feb. 28, 2001

(65) Prior Publication Data

US 2002/0117230 A1 Aug. 29, 2002

(51) Int. Cl.[7] ..... B21F 45/16; B42B 5/12
(52) U.S. Cl. ..... 140/92.93; 412/38
(58) Field of Search ..... 140/92.7, 92.93, 140/92.94, 92.9; 412/38

(56) References Cited

U.S. PATENT DOCUMENTS

| | | | | |
|---|---|---|---|---|
| 2,051,183 A | | 8/1936 | Schade | 281/16 |
| 2,051,477 A | | 8/1936 | Grumbacher | 281/25 |
| 2,051,738 A | | 8/1936 | Ottinger | 129/1 |
| 2,058,272 A | | 10/1936 | Taylor | 281/25 |
| 2,061,677 A | | 11/1936 | Schade | 281/25 |
| 2,078,988 A | | 4/1937 | Amato | 129/23 |
| 2,097,888 A | | 11/1937 | Leyerle | 11/1 |
| 2,101,804 A | | 12/1937 | Bidwell | 11/1 |
| 2,107,217 A | | 2/1938 | Salsman et al. | 11/1 |
| 2,112,389 A | | 3/1938 | Trussell | 281/25 |
| 2,112,991 A | | 4/1938 | Madden | 11/1 |
| 2,116,589 A | | 5/1938 | Trussell | 281/25 |
| 2,134,400 A | | 10/1938 | Grumbacher | 129/1 |
| 2,136,773 A | | 11/1938 | Hanna | 11/1 |
| 2,136,878 A | | 11/1938 | Grumbacher | 281/25 |
| 2,142,817 A | | 1/1939 | Gudis | 281/25 |
| 2,144,581 A | | 1/1939 | Trussell | 281/25 |
| 2,156,683 A | | 5/1939 | Dunwoodie, Sr. | 281/25 |
| 2,166,519 A | | 7/1939 | Catini | 11/1 |
| 2,177,054 A | * | 10/1939 | Catini | 140/92.93 |
| 2,181,662 A | | 11/1939 | MacDonnell | 281/25 |
| 2,185,004 A | | 12/1939 | Trussell | 281/25 |
| 2,188,680 A | | 1/1940 | Farkas | 129/1 |
| 2,193,348 A | | 3/1940 | Schade | 281/25 |
| 2,216,706 A | | 10/1940 | Freundlich | 281/25 |
| 2,228,110 A | | 1/1941 | Grumbacher | 16/180 |
| 2,228,355 A | | 1/1941 | Key | 129/1 |
| 2,236,169 A | | 3/1941 | Dunwoodie, Sr. | 281/25 |
| 2,327,941 A | | 8/1943 | Tauber | 281/21 |
| 2,336,856 A | | 12/1943 | Freundlich | 281/21 |
| 2,555,290 A | | 5/1951 | November | 281/25 |
| 2,638,609 A | | 5/1953 | Penner | 11/1 |
| 2,764,162 A | | 9/1956 | Valla | 129/1 |
| 2,961,012 A | | 11/1960 | Freundlich | 140/92.3 |
| 2,963,049 A | | 12/1960 | Biel et al. | 140/92.3 |
| 2,995,157 A | | 8/1961 | Catini | 140/92.7 |
| 3,122,761 A | | 3/1964 | Bouvier | 11/1 |

(List continued on next page.)

FOREIGN PATENT DOCUMENTS

| | | |
|---|---|---|
| CA | 717238 | 9/1965 |
| CH | 334662 | 4/1958 |
| FR | 1168073 | 12/1958 |
| GB | 2044676 | 10/1980 |

*Primary Examiner*—Lowell A. Larson
(74) *Attorney, Agent, or Firm*—Leydig, Voit & Mayer, Ltd.

(57) ABSTRACT

The automated machine includes exchangeable spacing assemblies from which the positions of the various rollers, as well as the curve of the perforations in the stack(s) of sheets are determined for a spiraling a given coil size into the stack of sheets. Various sizes of spacing assemblies are provided to allow the operator to the binding machine to bind various sizes of coils into a stack of sheets by exchanging the spacing assemblies. Two support surfaces support the halves of thick books, the coil spiraling through stacks of sheets positioned on both support surfaces simultaneously. The stack(s) of sheets with a coil inserted therethrough drops to a crimping station when the rollers separate and the support surfaces pivot toward a vertical position. Once the crimping operation has been performed, an ejector ejects the book from the crimping station, and book exits the machine under the force of gravity.

36 Claims, 21 Drawing Sheets

U.S. PATENT DOCUMENTS

| | | | | |
|---|---|---|---|---|
| 3,193,136 | A | 7/1965 | Stumpf et al. | 221/40 |
| 3,334,918 | A | 8/1967 | Pigna et al. | 281/25 |
| 3,367,649 | A | 2/1968 | Thomas et al. | 271/10 |
| 3,459,242 | A | 8/1969 | Schmidt | 140/92.93 |
| 3,467,150 | A | 9/1969 | Ostermeier | 140/92.94 |
| 3,486,537 | A | 12/1969 | Sickinger | 140/92.94 |
| 3,526,415 | A | 9/1970 | Freundlich | 281/21 |
| 3,568,729 | A | 3/1971 | Freundlich et al. | 140/103 |
| 3,592,242 | A | 7/1971 | Sickinger | 140/92.94 |
| 3,793,660 | A | 2/1974 | Sims | 11/1 |
| 3,818,954 | A | 6/1974 | Pfaffle | 140/92.3 |
| 3,826,920 | A | 7/1974 | Pfaffle | 140/92.7 |
| 3,889,309 | A | 6/1975 | Adams et al. | 11/1 |
| 3,924,664 | A | 12/1975 | Pfaffle | 140/92.7 |
| 3,967,336 | A | 7/1976 | Cutter | 11/1 |
| 3,972,109 | A | 8/1976 | Sickinger | 23/434 |
| 4,095,623 | A | 6/1978 | Lemburg et al. | 140/92.7 |
| 4,129,156 | A | 12/1978 | Pfaffle | 140/92.4 |
| 4,129,913 | A | 12/1978 | Pfaffle | 11/1 |
| 4,143,686 | A | 3/1979 | Sickinger et al. | 140/92.93 |
| 4,153,081 | A | 5/1979 | Lemburg et al. | 140/92.7 |
| 4,157,821 | A | 6/1979 | Fabrig | 270/53 |
| 4,161,196 | A | 7/1979 | Fabrig | 140/92.4 |
| 4,165,766 | A | 8/1979 | Fabrig | 140/92.7 |
| 4,185,668 | A | 1/1980 | Harbert | 140/92.4 |
| 4,208,750 | A | 6/1980 | Pfaffle | 11/1 |
| 4,232,858 | A | 11/1980 | Fabrig | 270/53 |
| 4,249,278 | A | 2/1981 | Pfaffle | 11/1 |
| 4,253,499 | A | 3/1981 | Lemburg et al. | 140/92.7 |
| 4,378,822 | A | 4/1983 | Morris | 140/92.3 |
| 4,403,896 | A | 9/1983 | Fabrig | 412/38 |
| 4,501,304 | A | 2/1985 | Lehmann | 140/103 |
| 4,545,603 | A | 10/1985 | Henes et al. | 281/21 |
| 4,607,993 | A | 8/1986 | Scharer | 412/40 |
| 4,609,206 | A | 9/1986 | O'Brien | 281/33 |
| 4,758,125 | A | 7/1988 | Wahl | 412/39 |
| 4,773,787 | A | 9/1988 | Chang | 402/60 |
| 4,874,279 | A | 10/1989 | Pfaffle | 412/39 |
| 4,907,905 | A | 3/1990 | Fournier | 402/80 R |
| 5,211,522 | A | 5/1993 | Ho | 412/16 |
| D365,580 | S | 12/1995 | Stiles et al. | D15/128 |
| D376,607 | S | 12/1996 | Mar et al. | D15/127 |
| 5,584,632 | A | 12/1996 | Stiles et al. | 412/39 |
| 5,695,308 | A | 12/1997 | Hastings et al. | 412/39 |
| 5,785,479 | A | 7/1998 | Battisti et al. | 412/39 |
| 5,837,344 | A | 11/1998 | Braun | 428/139 |
| 5,890,862 | A | 4/1999 | Spiel et al. | 412/40 |
| 5,934,340 | A | 8/1999 | Anthony, III et al. | 140/92.94 |
| 5,955,183 | A | 9/1999 | Braun | 428/222 |
| 6,000,897 | A | 12/1999 | DesJarlais | 412/40 |

* cited by examiner

AUTOMATED SPIRAL BINDING MACHINE

FIELD OF THE INVENTION

The invention relates generally to spiral binding machines, and more specifically to a personal machine for feeding a spiral coil through prepunched holes in sheets of paper and crimping the coil ends.

BACKGROUND OF THE INVENTION

Machines for spirally binding sheets of paper on a commercial scale are generally known in the art. For example, U.S. Pat. No. 4,378,822 to Morris, issued Apr. 5, 1983, discloses driving a spiral coil between a mandrel and a drive wheel. The drive wheel and the mandrel are disposed along one edge of the stack of sheets to be bound. However, the mandrel guides the coil only until the coil actually commences to spirally engage the punched holes of the sheets. Accordingly, a critical difficulty in this type of arrangement is reliably guiding the spiraling free end of the coil along the length of the papers and through the punched holes in the sheets.

Another device that has been used to guide the feed of a spiral coil into engagement with prepunched holes in a stack of sheets is a coiling tool, such as is described in U.S. Pat. No. 3,592,242 to Sickenger, issued Jul. 15, 1971. The coiling tool includes a mandrel which is surrounded by slotted member. Wire enters the slotted member at one end of the tool in the form of a wire which, as it turns, feeds successively through the series of punched holes in the sheet stack. While the guide members may be disposed along the length of the punched hole edge of the sheets to assist in directing the movement of the spiral wire as it spirally winds through the holes in the sheets, there still exist possibilities for jamming or mis-threading due to tension building-up along the spiral wire.

Spiral binding machines of this type are relatively large and generally inappropriate for desktop or office use. U.S. Pat. No. 5,785,479 to Battisti et al., which is likewise assigned to the assignee of this application, is one attempt to provide a desktop spiral binding machine. The disclosed device includes a movable cartridge for feeding the spiral coil. U.S. Pat. No. 5,934,340 to Anthony, III, et al., also assigned to the assignee of this application, similarly discloses a desktop binding machine. Both units feed a preformed coil through a stack of sheets and crimp the coil ends to complete a single book at a time. Additional devices are disclosed in U.S. Pat. No. 5,584,632 to Stiles et al. and U.S. Pat. No. 5,695,308 to Hastings et al. Both the Hastings reference and Stiles reference use a feeding mechanism similar to those described above with regard to the commercial scale machines in that the spiral coil is driven into the punched holes of the sheets by a drive wheel at one end of the paper.

Use of these office or desktop binders is relatively labor intensive, requiring considerable lag time while the operator waits for the book to be bound and the coil is crimped so that the bound book may be removed and the next stack of sheets placed. Thus, the binding processes of each of these devices are relatively time-consuming. Accordingly, while sized for office use, none of these devices are particularly well suited for high volume, relatively rapid binding in an office atmosphere.

Moreover, these devices only provide for the automated binding of books of a limited thickness and limited coil size. Among other things, this is due to such structural limitations as the size of the feeding elements, the available movement and action of the feeding rollers or wheels, and the predetermined curvature of the spacing assemblies.

Spacing assemblies of spiral binders are provided to either curve or angle the stack of paper to a position which is, ideally, optimal to coil insertion, that is a position in which curve match that of the coil as closely as possible. Such spacing assemblies are typically in the form of pins which extend through the prepunched opening in the stock of sheets or a curve surface which is disposed against an edge of the stack of sheets. In U.S. Pat. No. 6,000,897 to DesJarnlais, at least two spacing assemblies are provided adjacent a platen such that the edge of the papers arch to a concave shape matching the curve of the coil. In arrangements such as that disclosed in the Sickinger '242 patent, hooks extend through three ring binder holes in the sheet stack during the binding process. In the Stiles '623 patent and the Hastings '308 patent, the prepunched holes of the stack of sheets are positioned over locator pins extending upward through a platform or platen. Once the stack is secured in the desired position, the pins are retracted so that the coil may be advanced through the prepunched holes. In the Battisti '479 patent and the Anthony, III '430 patent, arcuate retractable locator pins are utilized to simulate the curve of the coil.

Inasmuch as these pin, hook, and curved surface spacing assemblies attempt to properly position the paper stack and/or simulate the curve of the coil to be utilized, only a given coil size or a narrow range of coil sizes may be inserted through the holes for a given spacing assembly. As a result, very small and very large books cannot typically be bound on such machines. While some machines may permit the spacing assemblies to be changed to allow for binding different book sizes, this is generally a time-consuming and labor intensive proposition which effectively eliminates the possibility of rapid binding for a large range of book sizes.

OBJECTS OF THE INVENTION

It is a primary object of the invention to provide a coil binding machine that may be used in an office environment or boutique copy store to reliably and rapidly assemble coils into a volume of books. It is also an object to provide a coil binding machine that may be quickly and easily adjusted to coil bind books having a wide range of sizes. A related object is to provide a coil binding machine that can bind relatively thick books in an automated process.

A further object of the invention is to provide a compact personal binding machine that may be utilized in an office atmosphere to bind a coil into a prepunched stack of sheets to provide a high quality bound book. A related object is to provide an automated personal binding machine that inserts a coil into a prepunched stack of sheets and crimps both ends of the coil, but minimizes interaction required by the user.

A further object of the invention is to provide a reliable, automated personal binding machine which consistently performs the operations of assembling a coil into a stack of sheets and consistently crimping the ends of the coil.

Yet another object of the invention is to provide a personal binding machine that may be used to coil-bind stacks of sheets of a variety of sizes of thicknesses.

These and other objects and advantages of the present invention will become apparent from the disclosure herein.

SUMMARY OF THE INVENTION

The invention provides an automated machine that may be utilized for spirally binding coils of various curvatures into stack of perforated sheets. The machine may be used with preformed wire or plastic coils and includes one or two support surfaces for supporting the sheets. Relatively thick books may be readily bound by positioning stacks of sheets on both of the support surfaces such that the coil is spiraled through both stacks simultaneously. One or more coil guiding assemblies are provided substantially adjacent the lower edge of the support surfaces for guiding the driven coil through the holes. In the preferred design, three such coil guiding assemblies are provided. The assemblies are in the form of a pair of rotatably mounted drive rollers and an idler roller, each of which is mounted for movement within the machine to adjust the clearance distance to account for various coil sizes.

To properly position elements of the coiling station, including the various rollers, and/or the perforations in the stack(s) of sheets, spacing assemblies having one or more support surfaces or shaping surfaces are provided. Various sizes and shapes of spacing assemblies are provided to allow the operator to the binding machine to bind various sizes of coils into a stack of sheets. The physical location of the rollers relative to the coil are determined by engagement surfaces of the coil guiding assemblies abutting the support surfaces of the spacing assemblies. Similarly, the channel(s) formed by the perforations in the stack(s) of sheets are determined by the edge(s) of the stack(s) of sheets being disposed against the convex shaping surfaces of the spacing assemblies.

Once a coil has been spiraled through the stack(s) of sheets, the coil guiding surfaces separate, and the support surfaces pivot toward a vertical position to allow the book to drop down a chute in the machine and into a crimping station. The crimping station includes a crimper for crimping the ends, and a clamp bracket for holding the coil in place during the clamping process. Once the crimping operation has been performed, an ejector ejects the book from the crimping station, and book exits the machine under the force of gravity.

These and other advantages of the present invention, as well as additional inventive features, will be apparent from the accompanying drawing and in the following detailed description.

DESCRIPTION OF THE PREFERRED EMBODIMENTS

Figure 1:
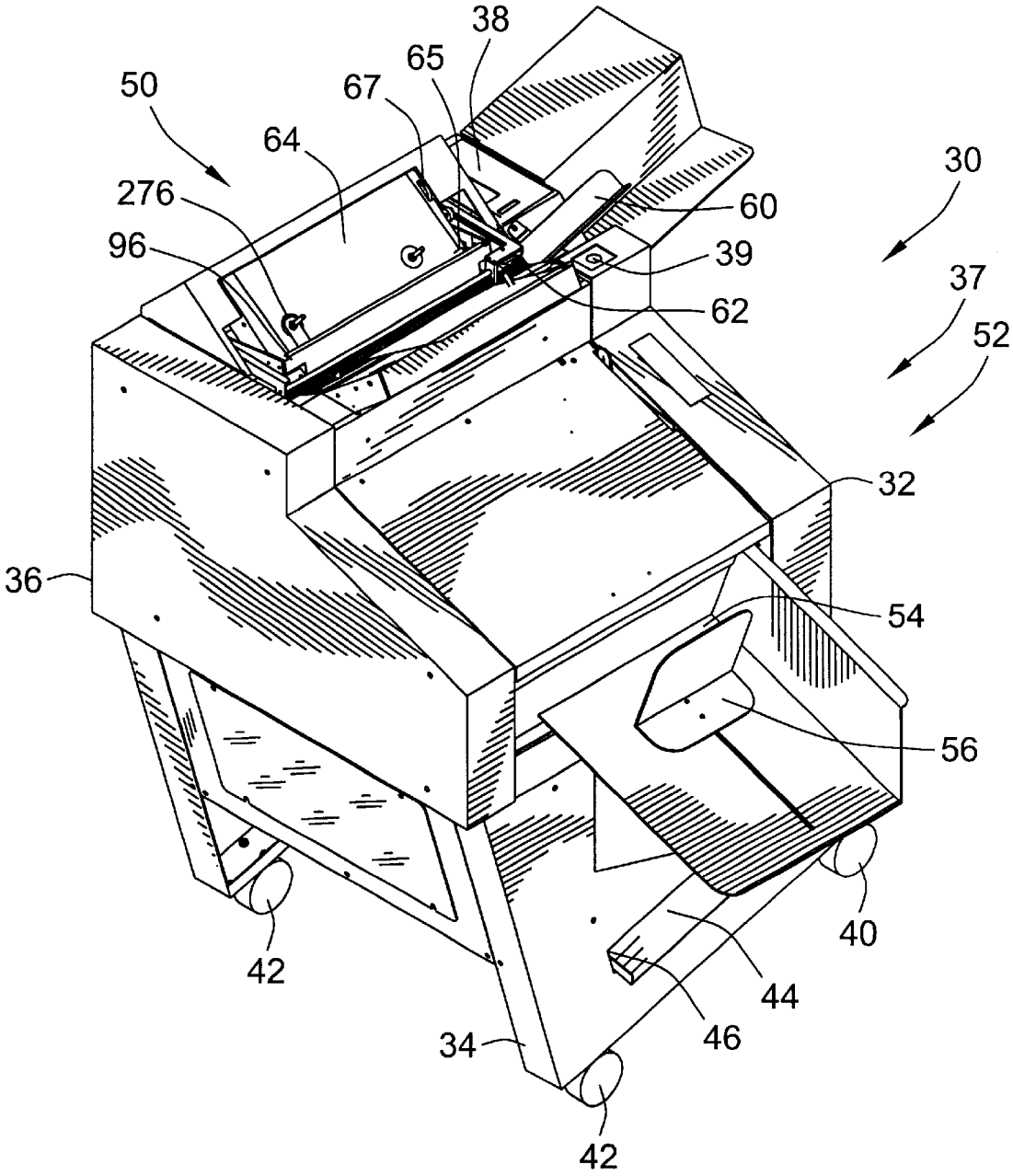
FIG. 1 is a perspective view of an automated spiral binding machine constructed according to teachings of the invention.

Turning now to the drawings, there is shown in FIG. 1 a perspective view of an automated machine 30 for assembling a preformed coil into a stack of sheets (not shown) having prepunched holes along a side edge. The machine 30 includes a housing 32 which has a base portion 34 and an upper housing portion 36. During use an operator would stand along the front 37 of the machine 30. Accordingly, along the upper, front portion of the machine 30 the machine's controls and function displays are exposed along a tactile finish keyboard 38. The machine 30 may include a start button along the keyboard 38 illustrated, or an alternate actuator, such as a foot pedal. Such a foot pedal may be pneumatically or otherwise operated. Likewise positioned in this area for easy access by the operator is an emergency stop button, preferably in the form of a large red mushroom actuator 39. In the event of an emergency, the operator need only depress the emergency button to cut power to the machine and stop all functions.

To facilitate movement of the machine 30 so that it may be, for example, stored when not in use, the base 34 is supported on conventional castors 40, 42 or other wheels or the like. In the preferred design, the front castors 40 are rigid, while the rear castors 42 are swivel castors.

Figure 2:
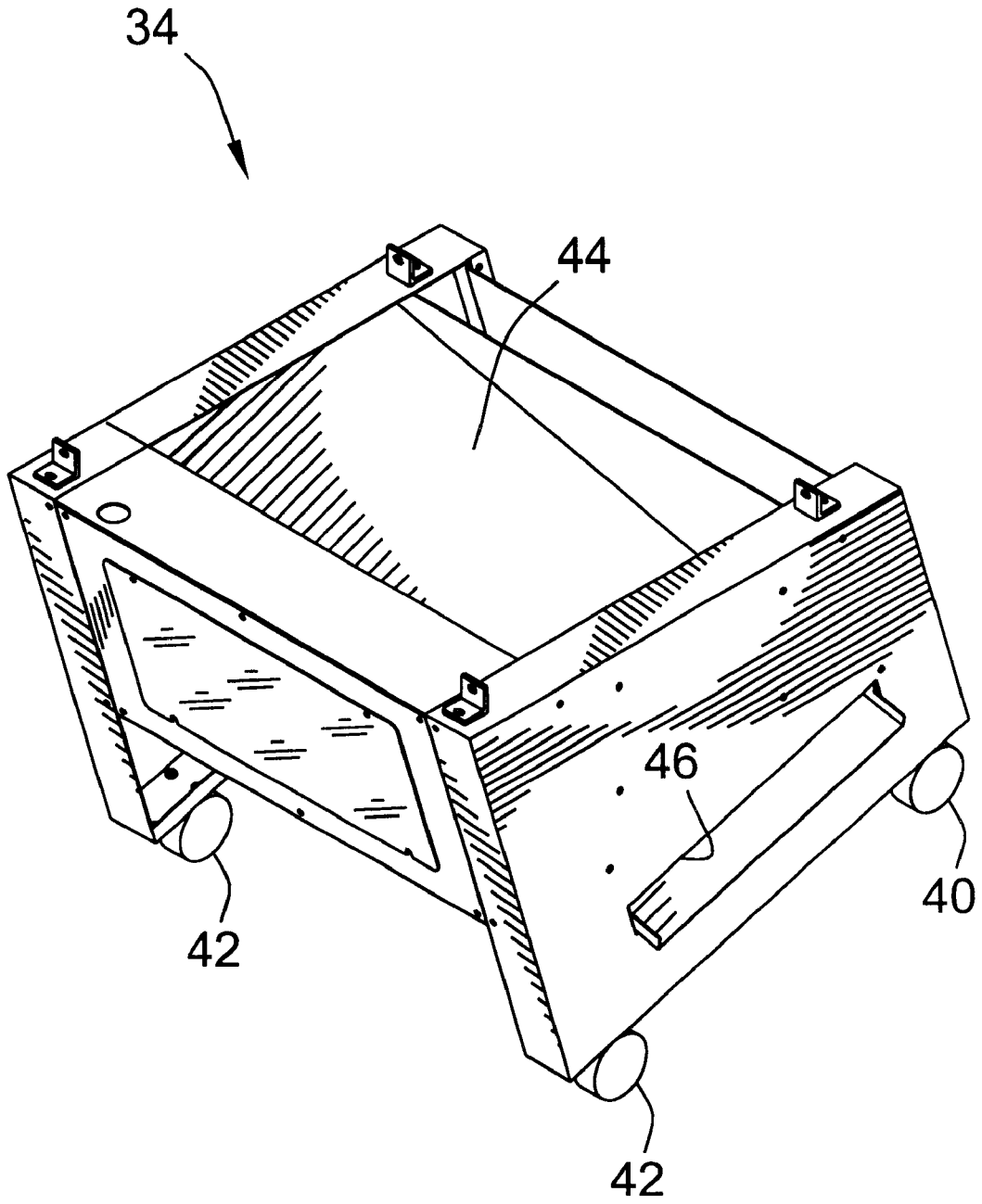
FIG. 2 is a perspective view of the base assembly of the machine of FIG. 1.

Further, in order to prevent the collection of waste or the loss of other materials or parts that may inadvertently be dropped into the machine, the base 34 further includes waste chute 44, as may best be seen in FIG. 2. The waste chute 44 angles downward in the base 34 and opens at a waste discharge opening 46 along one side of the machine 30. In this way, any papers, pieces of coil or other items dropped into the machine 30 will slide down the chute 44 and drop out of the opening 44 in the side of the machine 30. A waste collection basket (not shown) or the like may be positioned beneath the chute 44 and opening 46 to catch the waste.

Returning to FIG. 1, according to an important feature of the invention, the machine 30 is relatively small and can be easily moved, yet it will rapidly and efficiently assemble coils into stacks of sheets and crimp the ends in order to provide quality bound books in a relatively short time frame. In accomplishing this objective, the machine 30 includes a coiling station 50 and a separate crimping station 52 in the upper housing portion 36. In use, the operator loads a stack of prepunched sheets to be bound (not shown) and a coil (not shown) at the coiling station 50. The coiling station 50 then automatically spirals the coil into the prepunched holes. The book is then automatically advanced into the crimping station 52 where the ends of the coils are crimped and cut. The completed book is then dropped out of the side of the machine 30 into an output tray 54, where the assembled books are stacked. The tray 54 includes a movable backstop 56 which may be adjusted to accommodate assembled books of a range of widths such that the books will be neatly stacked in the tray 54 for later removal.

In other words, once the operator loads the stack of sheets and preformed coil into the coiling station 50, the complete binding of the book is performed without additional intervention from the operator. Additionally, once the first spirally bound book drops from the coiling station 50 into the crimping station 52, the operator may load another set of sheets and coil into the coiling station 50 for assembly. As the operator loads the next stack of sheets and coil into the coiling station 50, the crimping operation is performed on the first book. When the operator again depresses the start button, the completed first book will be dropped from the crimping station 52 into the output tray 54. Upon completition of the binding process on the second book, the second book drops from the coiling station 50 to the crimping station 52 for the crimping operation. In this way, in essence, the machine 30 can be binding two books at any one time, significantly decreasing the critical time for binding a book and increasing the machine 30 output. Moreover, the machine 30 does not require the operator to physically remove the book once the binding operation is complete, further increasing the efficiency of the machine 30 over prior art office devices and further minimizing labor expenditures in assembling a given number of books.

Turning now to the operation of the coiling station 50, as may be seen in FIGS. 1 and 3–5 when operating the machine 30, the operator lays a preformed coil (not shown) of an appropriate size along the coil loading bracket 60 with the end coils disposed in coil load bracket 62. The operator further positions a stack of prepunched sheets (not shown) along the paper support surface or tray 64 such that the edge of the paper is disposed adjacent an edge guide 65 which protrudes outward from the face of the tray 64 through an opening 66. In order to allow for fine adjustment of the edge guide 65 to account for various paper punch positions, the edge guide 65 is adjustable along the paper support tray 64 by means of the adjustment knob 67. The adjustment knob 67 is coupled to the edge guide 65 by a simple threaded linkage arrangement shown in the exploded view of FIG. 5. The edge guide 65 extends outward from the edge guide base 68, which is slidingly disposed along a pair of elongated rods 69 coupled to the paper support tray 65 such that the edge guide 65 protrudes through the opening 66 in the tray 64. The adjustment knob 67, which likewise protrudes through an opening 70 in the tray 64, is coupled to the edge guide base 68 by a threaded rod 71 such that the rotation of the adjustment knob 67 moves the edge guide 65 laterally along the tray 64.

According to an important feature of the invention, the machine 30 can bind books having a range of thicknesses, including relatively large thicknesses. It will be appreciated by those of skill in the art that thicker books are particularly difficult to bind. In accomplishing this objective, the coiling station 50 includes a second paper support surface or tray 80. As with the first support tray 64, the second support tray 80 includes an edge guide 82, which is similarly adjustable by rotation of adjustment knob 84 (see FIG. 5). Thus, when binding a larger stack of papers, the operator may place a portion of the stack on the first tray 64 and a portion of the stack on the second tray 80, preferably on the order of half the stack on each side. In this way, the machine 30 is essentially binding two small books simultaneously as opposed to one large book.

Figure 12:
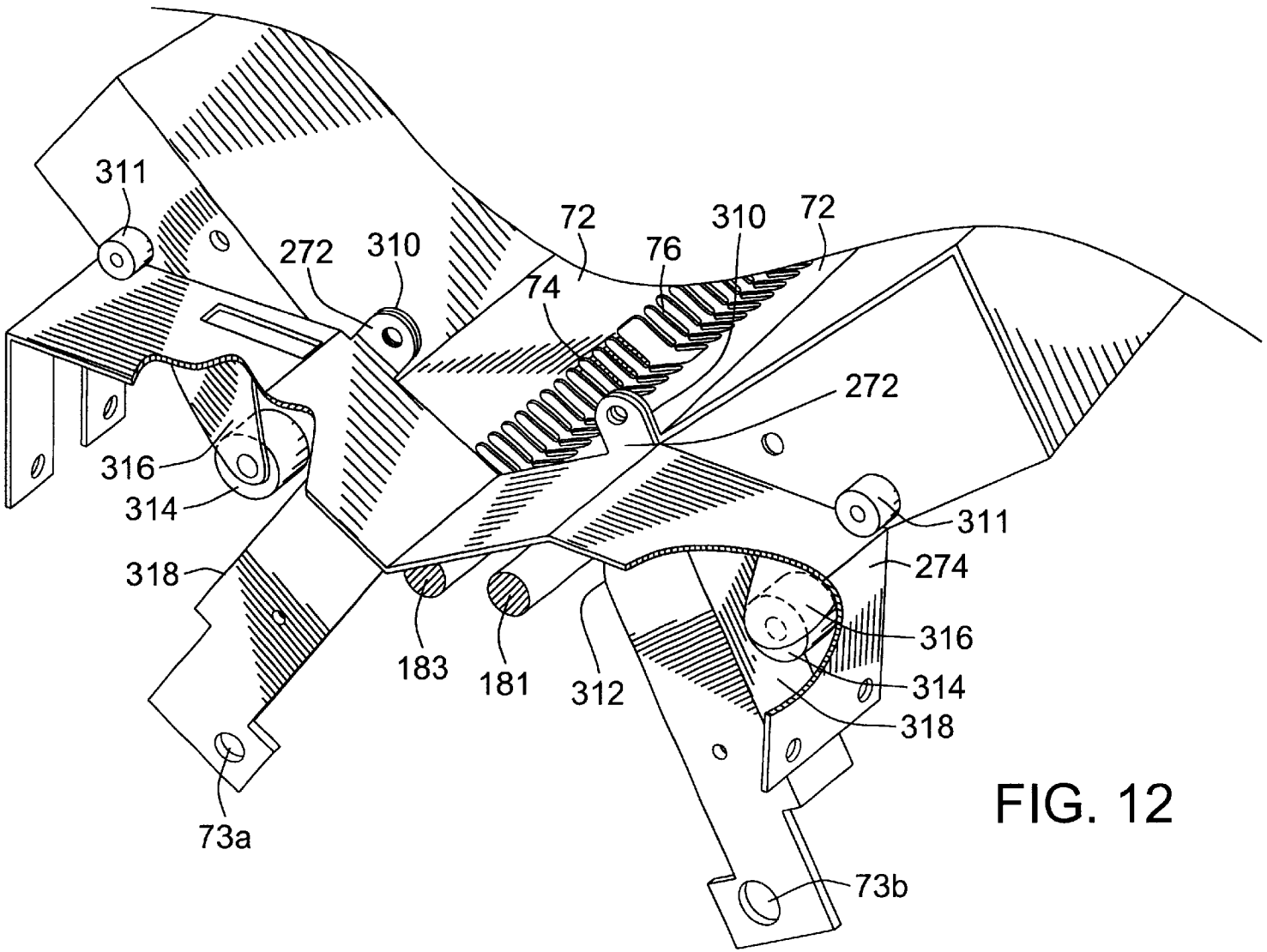
FIG. 12 is an enlarged fragmentary end perspective view of the trays and the combs.

As may be seen in FIG. 12, to support the lowermost edges of the paper stacks during the binding process, pivot combs 72*a*, 72*b* having a substantially flat plate portion with a series of arcuate grooves 74 and tines 76 are preferably disposed along the lowermost edge of the paper support trays 64, 80. The tines 76 and grooves 74 are spaced to correspond to the distance between successive wraps of a coil. In this way, the paper edge remains fully supported as the coil is advanced through the holes of the paper, the coil spiraling through the grooves 76. The combs 72*a*, 72*b* are pivotably mounted between the front and rear walls of the housing on stub shafts, to pivot about points 73*a*, 73*b*.

To advance the coil through the holes of the paper, the coiling station 50 one or more coil guiding assemblies, preferably in the form of a three point roller system, as is disclosed and described in greater detail in U.S. Pat. No. 5,934,340, which is likewise assigned to the assignee of the present invention, and is hereby incorporated herein by reference. In the preferred embodiment, elongated coil guiding surfaces in the form of two driven rollers 90, 92 provided subjacent the coil (see FIGS. 4 and 5) and an idler roller 94 disposed such that it is positioned along the top of the coil (see FIGS. 6 and 7) during the binding process. It has been determined that this arrangement provides a consistent and reliable spiraling of a coil through a paper stack. It will be appreciated, however, that alternate driving systems may be provided, as appropriate.

The lower most edges of the stacks of sheets are preferably positioned subjacent a coil guiding assembly, in this case, a pivot shaft assembly 96 which rotatably supports the idler roller 94, as may be seen in FIG. 1. As may best be seen in the detailed views of FIGS. 6 and 7, the pivot shaft assembly 96 has a plurality of nested arms which support elongated elements positioned just above the lower edges of the upper surface of the paper stack or on the upper surface of the coil.

The idler roller 94 is formed of polished stainless steel and has a grooved surface 95, the spacing of which corresponds to the spacing of the coil loops. The idler roller 94 is rotatably supported between idler pivot arms 100, 102 via radial ball bearings 104, which provide smooth, free rotation of the idler roller 94. While the rear pivot arm 100 is substantially planar, the front pivot arm 102 includes an offset portion 106 through which an adjustment screw 110 extends (see FIG. 7). The significance of this offset portion 106 and adjustment screw 110 will become apparent upon further explanation of the pivot shaft assembly 96. In order to maintain smooth operation of the idler roller 94, the proper spacing of the idler pivot arms 100, 102 is maintained by a cross bar 112 and a cross rod 114, which are both secured by screws or the like through bores 116 at opposite ends of the arms 100, 102. In this way, the idler roller 94 may freely rotate with the coil as the coil is spiraled into the holes in the stack of sheets.

Figure 7:
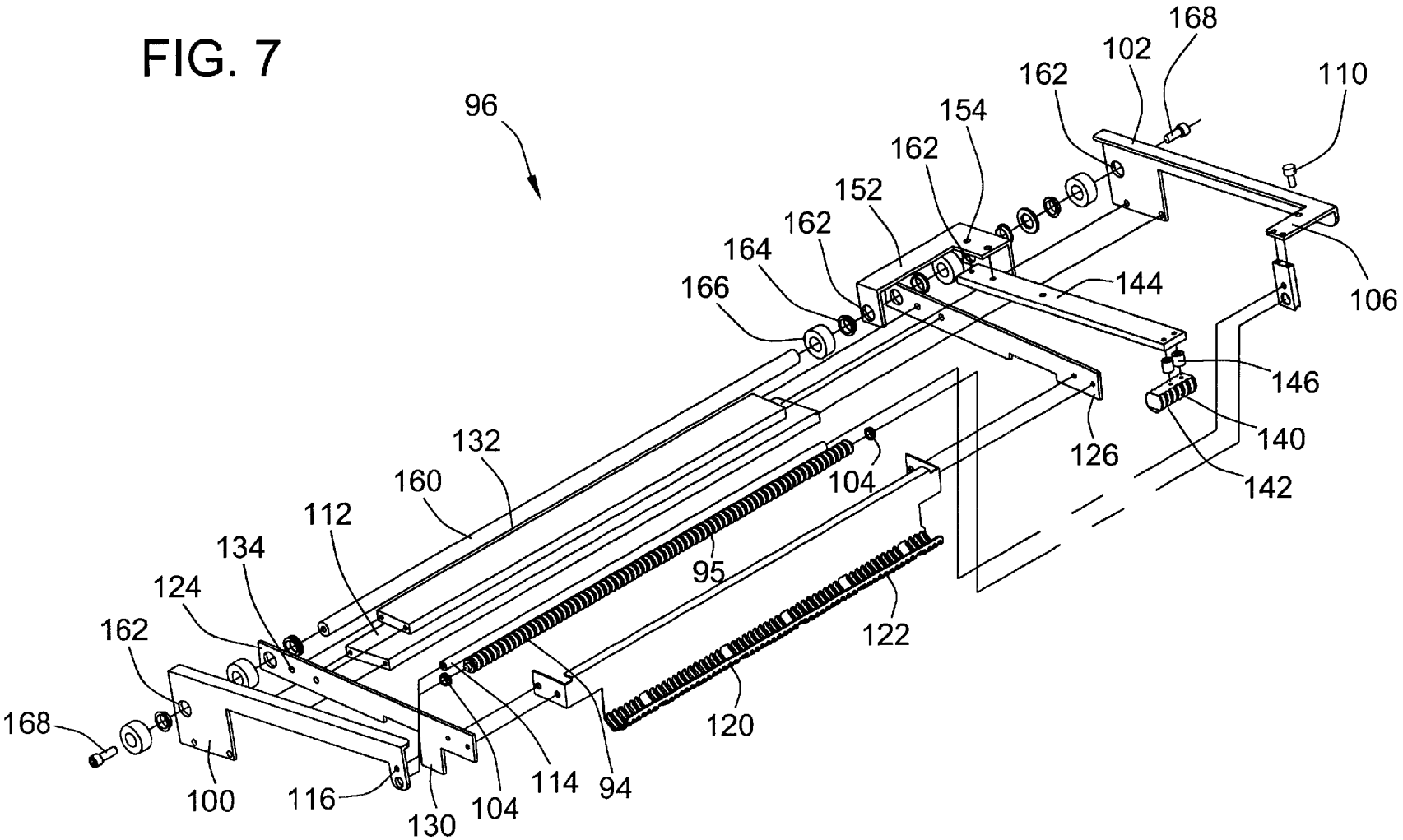
FIG. 7 is an exploded perspective view of the pivot shaft assembly shown in FIG. 6.

In order to ensure that the edges of the paper stack(s) do not lift as the coil is advanced through the holes in the sheet stack(s), the idler roller 94 is disposed within a stripper bracket 120 when in use. As best seen in FIG. 7, the stripper bracket 120 has an elongated trough-like shape and comprises a series of elongated openings or holes 122 along its length. The spacing of the holes 122 corresponds to the spacing between consecutive loops of the coil. In this way, during the binding operation, the loops of the coil extend through these openings 122 to contact the idler roller 94 so that spiraling of the coil through the sheet holes rotates the idler roller 94 to assist in moving the coil forward, while the stripper bracket 120 maintains the proper positioning of the paper stack edges.

The stripper bracket 120 is disposed between stripper bracket arms 124, 126. As may be seen in FIG. 7, the arms 124, 126 are preferably substantially planar. The rear arm 124, however, comprises a flat spacing surface or engagement surface 130 which protrudes from the lower edge of the arm 124. The operation of this engagement surface 130 will become clear upon further explanation of the coiling station 50. The stripper bracket 120 being disposed between one end of the arms 124, 126, the spacing of the other end of the arms 124, 126 is maintained by a cross bar 132. The cross bar 132 as well as the stripper bracket 120 are secured to the stripper bracket arms 124, 126 by screws or the like through bores 134.

Finally, in order to initiate the feeding of the positioned coil into the holes of the papers, a non-rotating substantially cylindrical start segment 140 is provided. The segment 140 is disposed along the coil load bracket 62 in the assembled machine 30 in order to ensure that adequate downward force is placed on the loaded coil to engage the coil with the lower drive roller sections 90, 92, which will be described in greater detail with regard to the main roller assembly 170 shown in FIGS. 4 and 5. The segment 140 has a grooved polished steel surface. As with the idler roller 94, the spacing of the grooves 142 corresponds to the spacing between the loops of the coil. The grooves 142 of the segment 140 are slightly more shallow than those 95 of the idler roller 94, and the segment 140 has a slightly larger diameter than the idler roller 94. It will be appreciated, however, that the segment could be a rotatable roller segment, or a planer surface, preferably with grooves, so long as the segment provides sufficient downward force on the coil to hold the coil into contact with the drive rollers to initiate advancement of the coil into the holes of the stack of sheets.

The start segment 140 is coupled to the arm 144 by spacers 146 and screws. The arm 144 is likewise coupled to the pivot bracket 152 by screws extending through bores 154.

Figure 6:
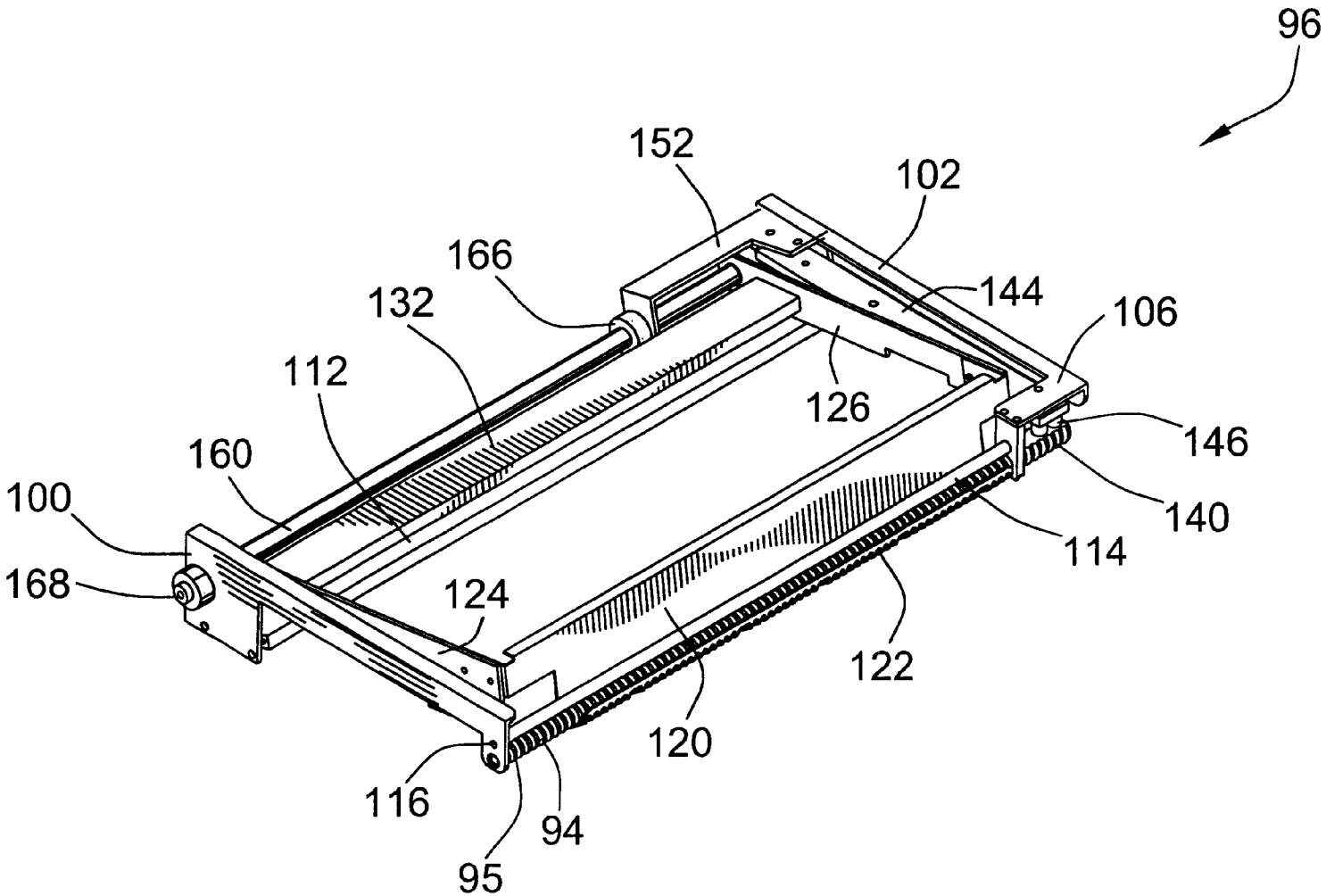
FIG. 6 is a perspective view of the pivot shaft assembly of the coiling station of the machine of FIG. 1.

The idler pivot arms 100, 102, the stripper bracket arms 124, 126, and the start segment arm pivot bracket 152 are nested as shown in FIGS. 6 and 7, and are all pivotably coupled within the coiling station 50 by way of a loading pivot shaft 160 by way of bores 162 in each of the arms 100, 102, 124, 126 and bracket 152 through which bearings 164 are disposed to provide smooth, free movement of the arms. Spacing is maintained between the arms by means of shaft collars 166, which allow smooth movement between the respective arms. These elements are coupled to the shaft by means of screws 168 to form the pivot shaft assembly 96 shown in FIGS. 6 and 7.

Returning now to the adjustment screw 110, it will be appreciated that the tip of the adjustment screw 110 disposed through the offset portion 106 of the idler pivot arm 102 is disposed along the top of the arm 144 such that the screw 110 may be rotated to fine tune the spacing between the arms 102, 144 and the position of the idler roller 94 relative to the start segment 140. It is presently envisioned that the adjustment screw 110 will be preset at the factory to the optimal positioning. As may be seen in FIG. 3, the pivot shaft assembly 96 is disposed such that the stripper bracket 120, the idler roller 94, and the start segments 140 are all disposed via gravity at their lowermost positions unless alternately pivoted.

Figure 4:
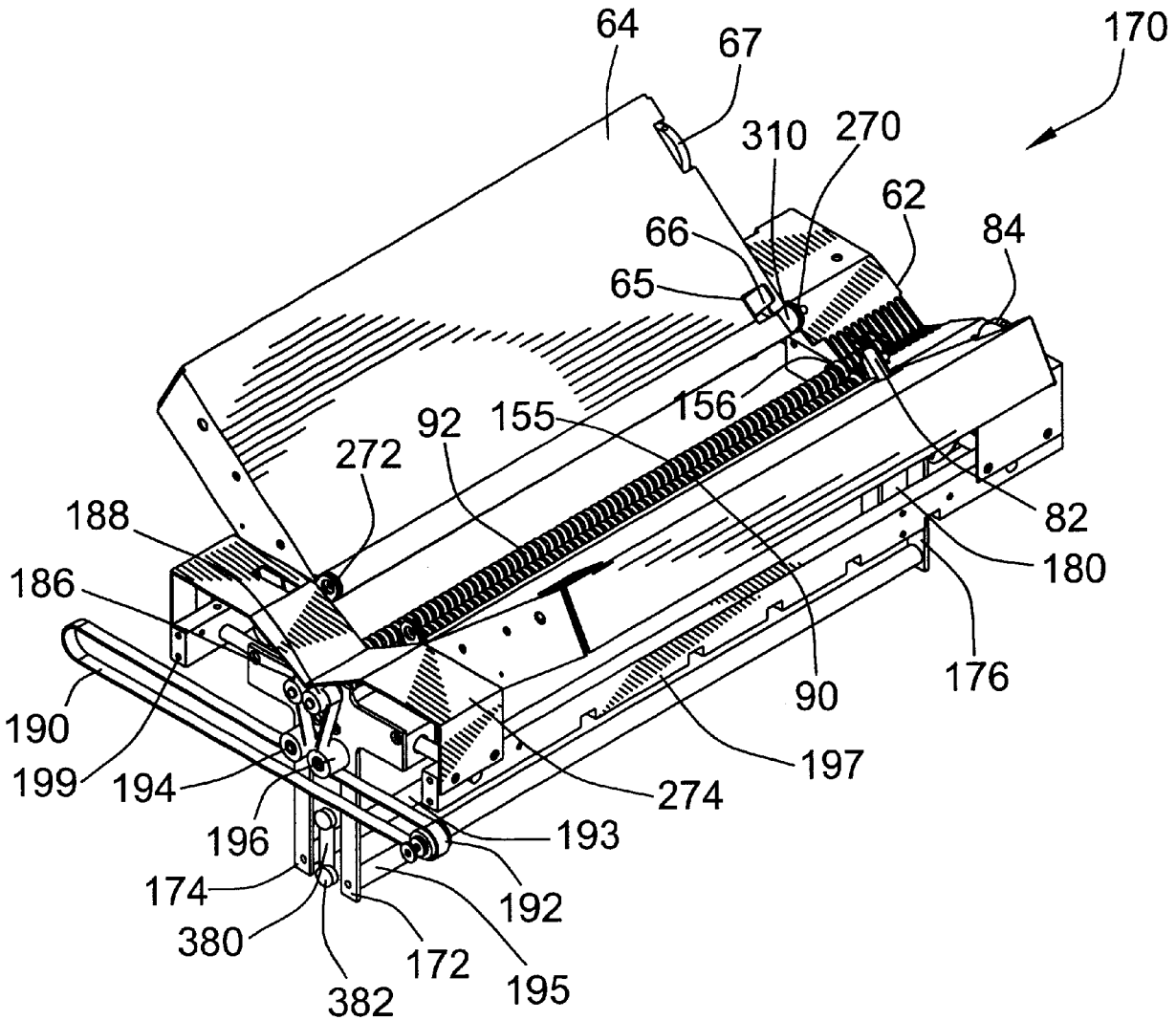
FIG. 4 is a perspective view of the main roller assembly of the coiling station of the machine of FIG. 1.
Figure 5:
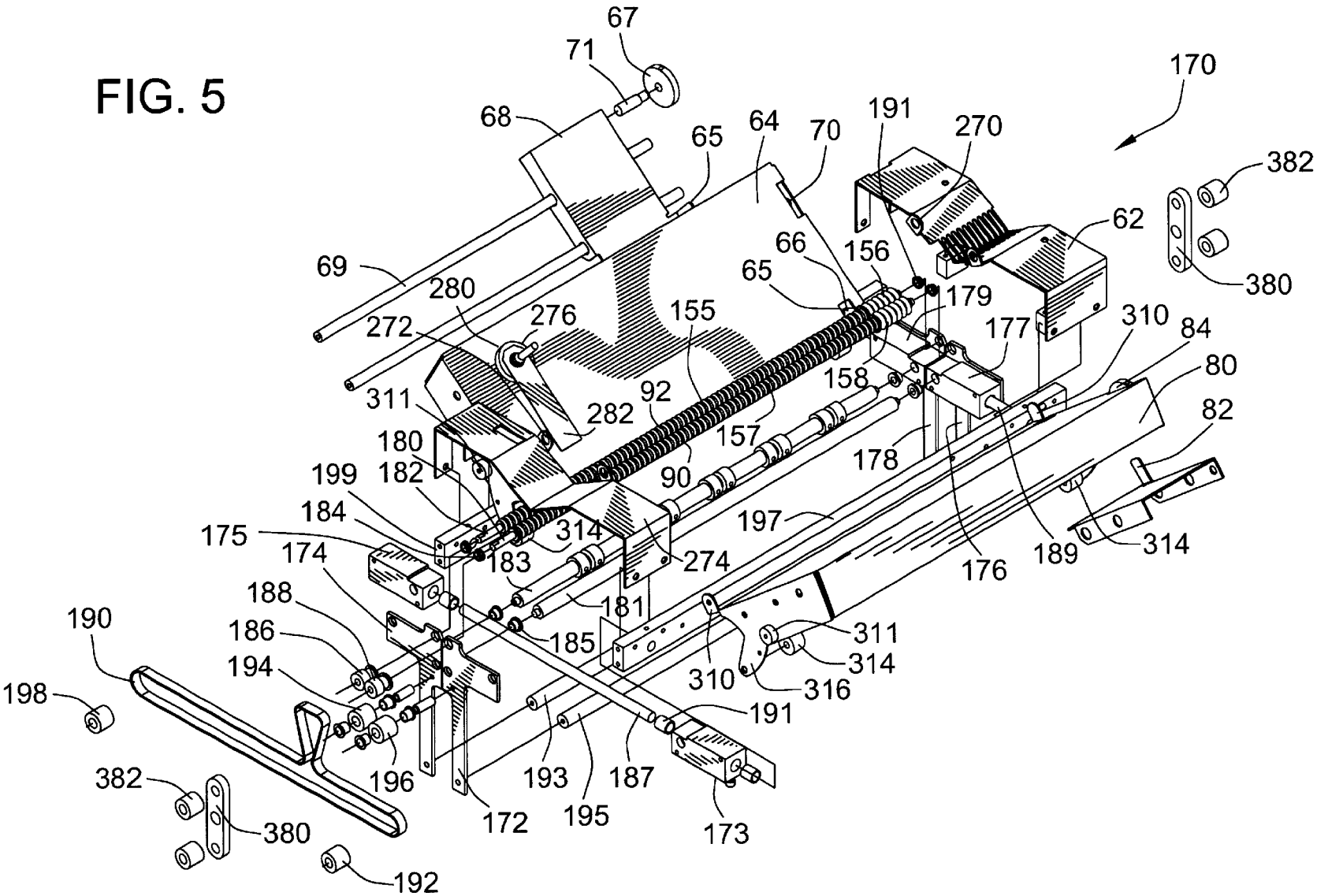
FIG. 5 is an exploded perspective view of the main roller assembly shown in FIG. 4.

Turning now to the main roller assembly 170 shown in FIGS. 4 and 5, in order to advance the coil through the holes in the paper, two rollers 90, 92 are disposed subjacent the idler roller 94. While both of these rollers are drive rollers 90, 92 in the preferred embodiment, it will be appreciated that alternate drive arrangements could be utilized so long as adequate force is applied to drive the coil through the holes of the paper.

As may be seen in FIGS. 4 and 5, the drive rollers 90, 92 each include an elongated portion 155 which is disposed subjacent the idler roller 94 and a relatively shorter end portion 156 which is disposed subjacent the coil load bracket 62 and the start segment 140. As with the idler roller 94, the elongated portion 155 of each of the drive rollers 90, 92 is preferably polished steel and comprises circumferential grooves 157 which are spaced apart the same distance as the turns of the coil. When using the preferred one-half inch (½") diameter shaft, the grooves 157 are disposed at an angle on the order of 140.

In contrast, in order to facilitate the initial movement of the coil when positioned on the coil load bracket 62, the relatively shorter end portions 156 similarly include circumferential grooves 158, but are coated with urethane or another material or otherwise finished to provide enhanced friction. In addition, grooves 158 at the end portions 156 are preferably disposed at a slightly greater angle than those 157 of the polished steel elongated portions. Significantly, however, each roller 90, 92 has a uniform functional diameter for most coil wire sizes, that is, the end portions 156 have a slightly larger outer diameter and a slightly smaller diameter in the lowermost point of the grooves 158 than that of the elongated portions 155. It will be appreciated that, during use, with the weight of the start segment 140 on the top of the coil forces the coil into contact with the urethane-coated end portions 156 of the drive rollers 90, 92, such that rotation of drive rollers 90, 92 causes the coil to spiral forward and into the holes of the paper, the elongated portions of the rotating drive rollers 90, 92 continuing to move the coil forward through the holes. In this way, the drive rollers 90, 92 act as elongated coil guiding surfaces.

The rollers 90, 92, 94 are disposed 120° apart around the circumference of the coil during insertion. According to an important feature of the invention, the grooves of the respective rollers 90, 92, 94 are disposed such that they drive the coil forward through the openings in the paper. In this regard, the grooves of each consecutive roller are staggered such that they are one-third (⅓) the distance apart. Thus, as a loop of a coil contacts the grooves of each roller in order, the loop is urged downward into the groove, urging the coil forward.

To maintain the respective position and allow driven movement of the drive rollers 90, 92, the rollers 90, 92 are rotatably coupled to roller plates 172, 174, 176, 178 at either end, the shafts 180, 182 of the respective rollers 90, 92 extending through ball bearings 184 disposed within the plates 172, 174, 176, 178. The relative positions of the lower-most ends of the roller plates 172, 174, 176, 178 are maintained by shafts 193, 195 which similarly extend therebetween. As may best be seen in FIG. 4, the rear ends of the roller shafts 180, 182 extend through the roller plates 172, 174 and are coupled to timing pulleys 186, 188.

To provide drive rotation to the timing pulleys 186, 188, and, accordingly, the respective drive rollers 90, 92, a timing belt 190 couples a drive source from an appropriate motor (not shown) at drive wheel 192 coupled to the housing. The belt 190 extends about the drive wheel 192 and the timing pulleys 186, 188, as well as idler wheels 194, 196, 198. Idler wheels 194, 196 are rotatably coupled to the roller plates 174, 172, respectively, and idler wheel 198 is rotatably coupled to the housing. In this way, as rotation is imparted to the drive wheel 192 from an appropriate motor, the belt 190 couples the motor to the drive rollers 92, 94 to provide rotation of the drive rollers 92, 94 in order to drive the coil through the paper openings.

Significantly, the distance between the drive rollers 90, 92 is adjustable so that the parallel rollers 90, 92 may be moved between positions toward or away from each other to accommodate different sizes of coils for binding. Accordingly, the plates 172, 174, 176, 178 are secured to bearing blocks 173, 175, 177, 179, respectively. To facilitate the lateral movement of the rollers 90, 92, pairs of the bearing blocks 173, 175, and 177, 179 are slidably disposed on a pair of shafts 187, 189 extending at a normal angle to the axes of the rollers 90, 92. The shafts 187, 189 are mounted between shaft mounting bars 197, 199, which are in turn coupled to the coil loading bracket 62 and rear roller guide 274 disposed at the front and back portions of the housing, as well as the housing itself. The rear drive roller slide shaft 187 and the front drive roller slide shaft 189 are mounted within the machine 30 at opposite ends of the rollers 90, 92. It will be appreciated that the respective positions of the rollers 90, 92 may thus be varied by moving the bearing blocks 173, 175, 177, 179 toward or away from one another along the shafts 187, 189. Sleeve bearings 191 are disposed between the bearing blocks 173, 175, 177, 179 and the respective drive roller slide shafts 187, 189 to ensure smooth lateral movement of bearing blocks 173, 175, 177, 179. In this way, the space between the driver rollers 90, 92 may be varied while providing smooth and reliable spiraling of various sizes of coils through supported stacks of sheets.

Also extending between the bearing blocks 173, 175, 177, 179 and the plates 172, 174, 176, 178 are a pair of guide shafts 181, 183. While not required by the invention, the guide shafts 181, 183 are preferably rotatably mounted, the ends of the guide shafts 181, 183 similarly extending through bearings 185, the blocks 173, 175, 177, 179, and the plates 172, 174, 176, 178.

Just as the distances between the rollers 90, 92 may be adjusted to provide for the insertion of various sizes of coils, the location of the idler roller 94 and the positioning stacks of paper supported on the support tray(s) 64, 80 may be adjusted to provide smooth movements of the coil through the paper stack. In order to provide quick and reliable settings for the various binding elements of the machine that affect the coil being advanced through the holes of a paper stack, as well as the positioning of the paper stack itself, a plurality of exchangeable spacing assemblies 200 are provided which determine the relative positions of the drive rollers 90, 92, the idler roller 94, and the stack of papers to be bound. Spacing assemblies 200 are disposed along the lower most edge of the support trays 64, 80 to adjust the edge of the paper stack, and, accordingly, the channel formed through the paper by the prepunched holes, as may best be seen in FIG. 8.

Each spacing assembly 200, 210, which is preferably in the form of a relatively flat plate, presents a number of surfaces against which engagement surfaces of the pivot shaft assembly 96 (FIGS. 6 and 7) and main roller assembly (FIGS. 4 and 5), as well as edges of a stack of sheets are disposed in order to obtain proper orientation for insertion of a coil into the sheets. (See FIGS. 8–11.) In use, a plurality of the spacing assemblies 200, 210 are positioned in a chamber 218 (see FIG. 3) subjacent one of the paper support trays 64 such that the various surfaces of the spacing assemblies 200, 210 engaged by the paper stack disposed on one or both of the support trays 64, 80 and are engaged by and govern the movement of components of the machine 30 during set-up, binding, and further moving the bound book to a crimping station. The significance of these surfaces will be explained in turn.

Figure 8:
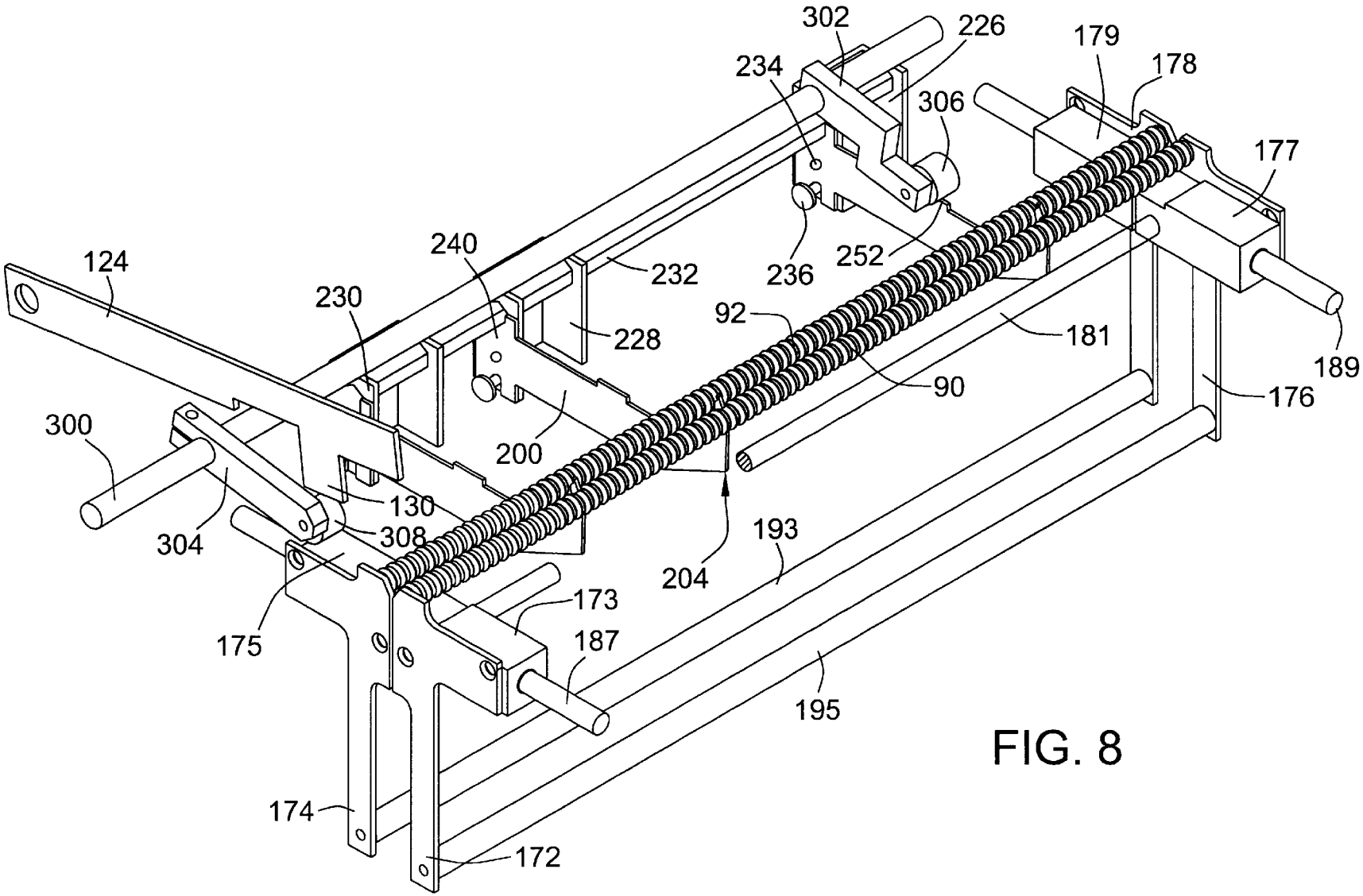
FIG. 8 is a perspective view of portions of the spacing assembly and the main roller assembly of the coiling station of the machine of FIG. 1.

It has been found that two to three such spacing assemblies 200 are sufficient to support and form most standard size books, although a greater or smaller number of spacing assemblies may be provided. For optimum operation of the coiling station 50, however, preferably three such spacing assemblies are provided, as will be explained in more detail below. Preferably, a range of sizes of spacing assemblies are provided in order to govern the appropriate orientation of the drive and idler rollers 90, 92, 94 and the stack of sheets to be bound for various coil sizes or curvatures. Spacing assemblies 200 for use in binding small size books are illustrated in FIGS. 8 and 10, while spacing assemblies 210 for use in binding larger size books are illustrated in FIGS. 9 and 11.

According to an important feature of the invention, the operator may quickly and efficiently change the coiling station 50 set up to bind substantially any desired book thickness with an appropriately sized coil. To this end, the operator need only change the spacing assemblies 200, 210 to the desired size in order to automatically adjust both the spacing assembly spacing surface(s) which govern the locations of the stack(s) of sheets to be bound and drive and idler rollers 90, 92, 94.

Figure 3:
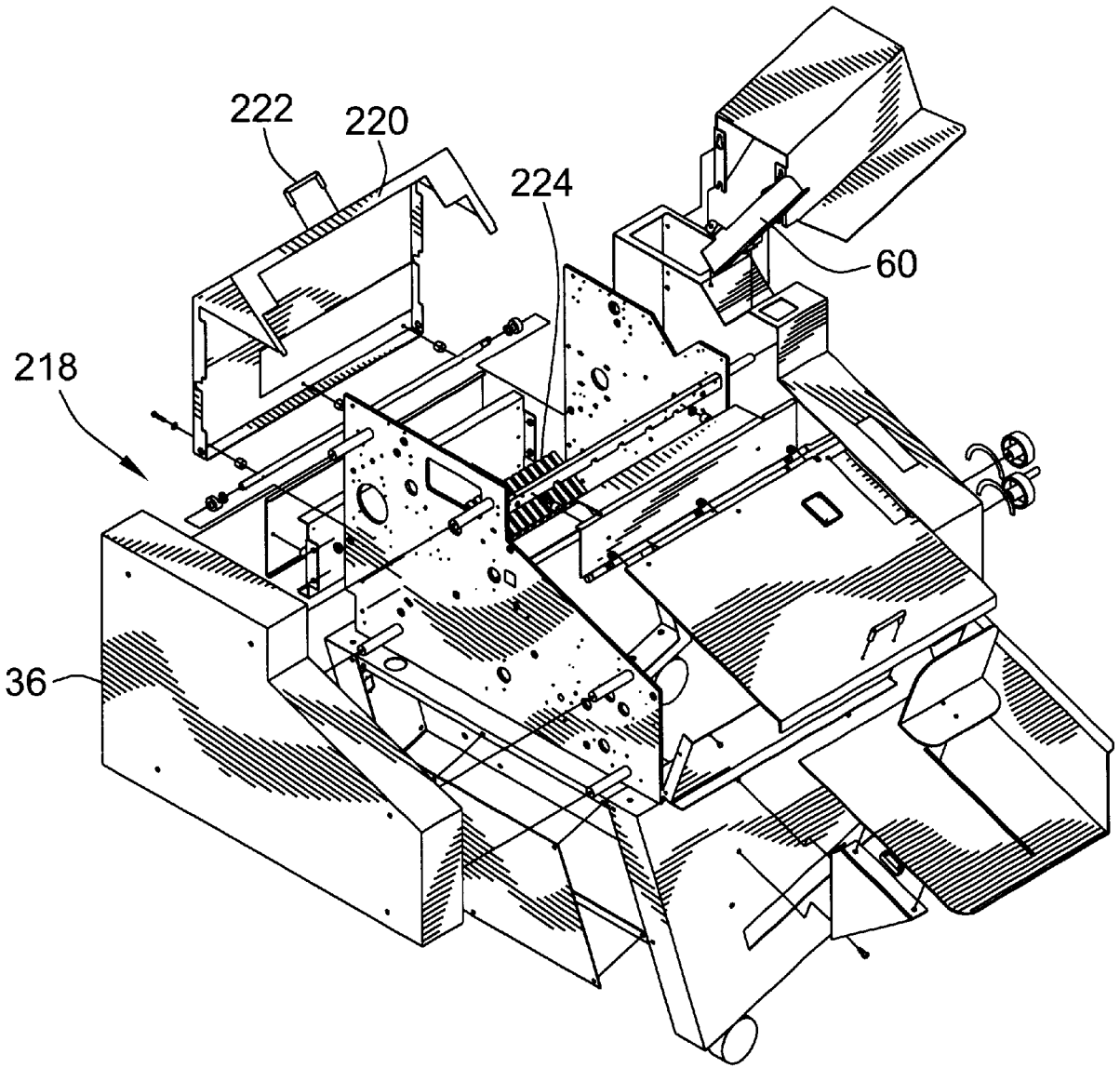
FIG. 3 is a perspective exploded view of components of the upper portion of the machine of FIG. 1.

In order to provide easy access to the spacing assemblies 200, 210, contained within chamber 218, the housing 32 is provided with a spacing assembly access cover 220 having a handle 222, as may be seen in FIG. 3. Sets of the various sizes of spacing assemblies 200, 210 are organized in a storage tray 224 in the chamber 218 so that the operator may easily access a desired size. In the preferred embodiment, three spacing assemblies 200, 210 of each given size are provided.

Figure 9:
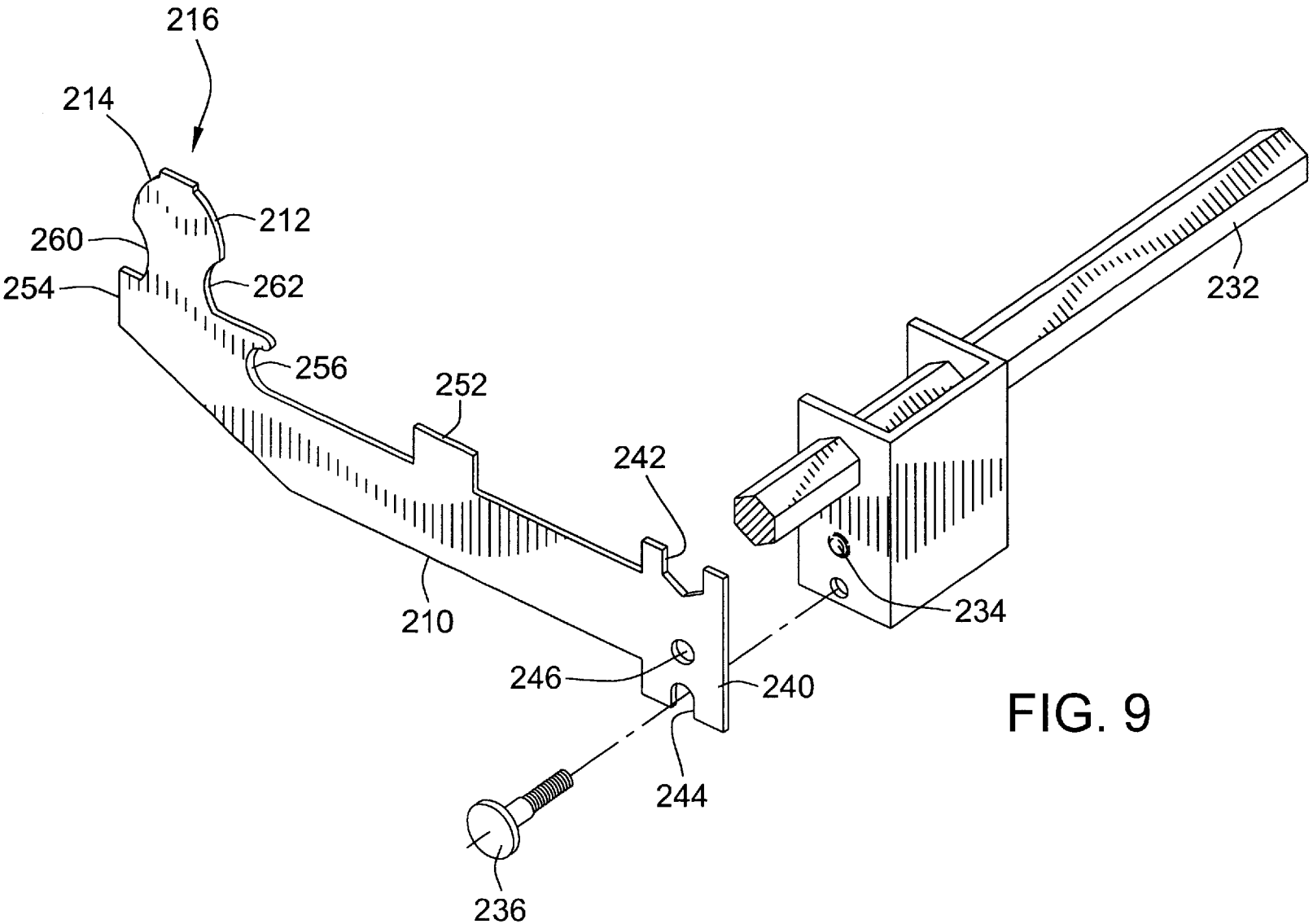
FIG. 9 is an enlarged fragmentary perspective view of a spacing assembly being assembled to a spacing assembly bracket.
Figure 10:
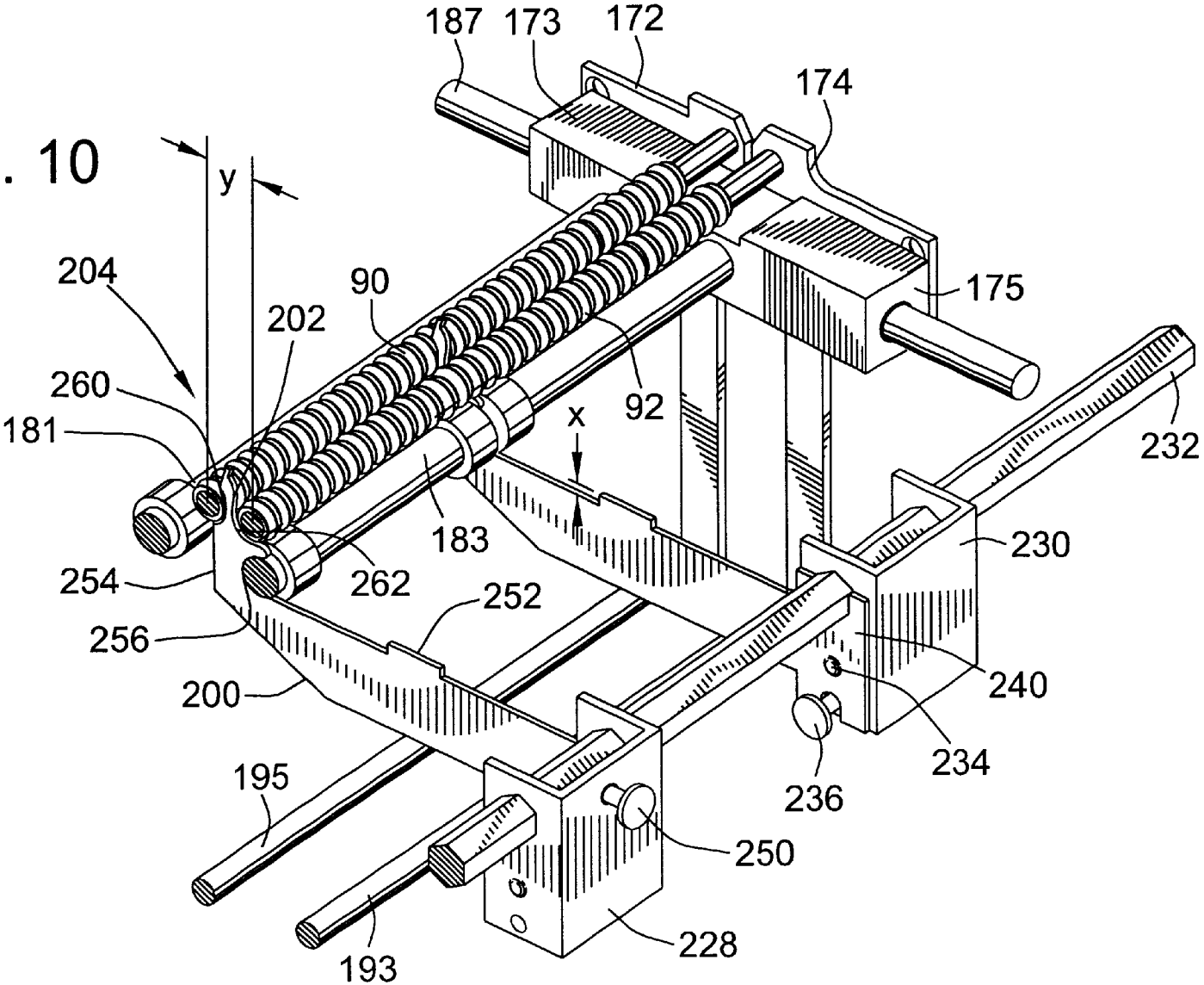
FIG. 10 is an enlarged fragmentary perspective view of a small size spacing assembly and associated components of the spacing assembly assembly for assembly of a small sized coil into a small stack of sheets.
Figure 11:
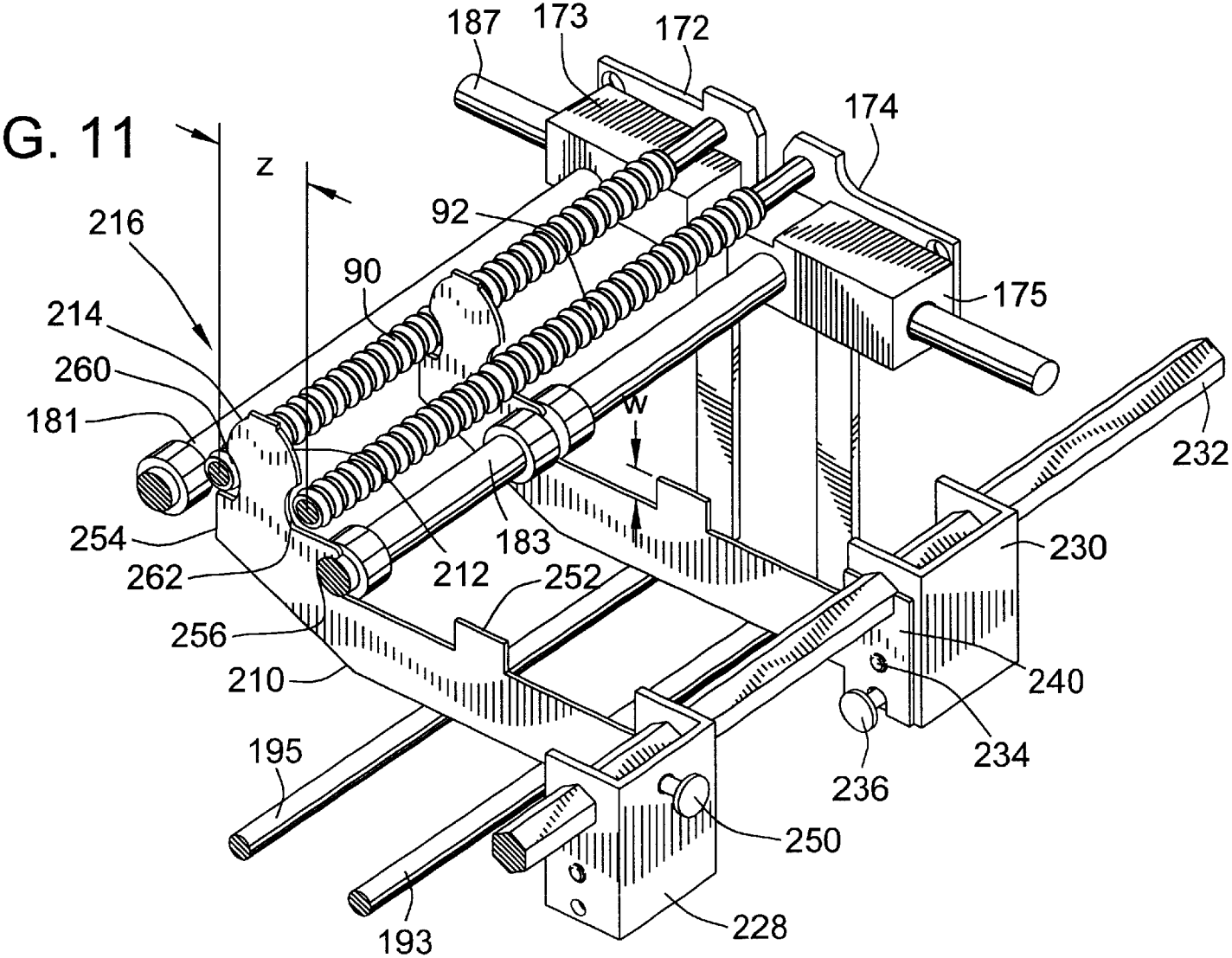
FIG. 11 is an enlarged fragmentary perspective view similar to the view of FIG. 10, but including a larger size spacing assembly for assembly a coil of a larger size into a larger book wherein stacks of sheets are disposed on both trays.

As may be seen in FIGS. 8–11, the spacing assemblies 200, 210 are supported on spacing assembly brackets 226, 228, 230 or mounting structures disposed along a hexagonally-shaped spacing assembly shaft or rod 232. To facilitate locating and securing the spacing assemblies 200, 210 to the brackets, the spacing assembly brackets 226, 228, 230 further include a locating boss 234 and a large finger tightening knob 236 on a threaded rod 238. As best seen in FIGS. 9–11, each spacing assembly 200, 210 is an elongated structure with a base 240 opposite its distal end 204, 216. The base 240 includes mating structure for receiving the hexagonal rod 232, boss 234, and threaded rod 238 of the tightening knob 236, as best seen in FIG. 9. More specifically, the spacing assemblies 200, 210 include notches 242, 244 for receiving hexagonal rod 232 and threaded rod 238. The base 240 further includes a depression or bore 246 for receiving the locating boss 234.

Thus, in order for the operator to couple a spacing assembly 200, 210 to a spacing assembly bracket 226, 228, 230, the knob 236 is loosened sufficiently to allow the spacing assembly base 240 to be slid between the knob 236 and the spacing assembly brackets 226, 228, 230. In so positioning the spacing assembly base 240, it will be appreciated that the bore 246 will be positioned over the boss 234. It will also be appreciated that the relative shapes of the notches 242, 244 and location of the bore 246 only allow the spacing assemblies 200, 210 to be positioned in the proper orientation. Once positioned, the operator simply finger tightens the knob 236 to secure the spacing assembly 200, 210 in position.

Preferably, spacing assembly brackets 226, 230 are secured to the hexagonal rod 232 substantially adjacent opposite ends of the support tray 64, and the third bracket 238 is slidably coupled to the rod 232 along the edge of the tray 64 between brackets 226 and 230. The slidably coupled center bracket 228 may be slid laterally along and secured to the rod 232 at any desired position between the outer stationary brackets 226, 280 by simply a loosening/tightening screw via knob 250. In this way, the center spacing assembly 200, 210 may be positioned at the appropriate location for the paper size to be bound.

According to an important feature of the invention, the spacing assemblies 200, 210 have a plurality of spacing surfaces which control the positions of the stack(s) of paper to be bound, as well as the three rollers 90, 92, 94 which spiral the coil into the paper stack in the coiling station 50. In order to orient the paper stack such that the channel formed by the prepunched holes in the stack simulates the curve of the coil to be inserted, the small size spacing assembly 200 includes a convex edge or shaping surface 202 at its distal end 204 which simulates the curve of the coil. As may be seen from FIGS. 8 and 10, the convex edge 202 of the spacing assembly 200 is disposed at the bottom edge of the support tray 64. In this way, the bottom edge of a stack of sheets disposed on the support tray 64 takes the shape of the convex edge 202, i.e., the convex edge 202 produces a corresponding concave stack edge, and concave channel of the prepunched holes. It will be appreciated by those of skill in the art that the convex edge 202 of the spacing assembly 200 for small book sizes is bent and twisted slightly in the direction of the coil spirals.

To form the edges of larger sized books, the spacing assembly 210 is provided for concurrently forming the edges of stacks of paper disposed on both paper support trays 64, 80. As shown in FIG. 11, a spacing assembly 210 according to this aspect of the invention includes convex shaping surfaces 212, 214 along either side of the distal end 216 to form the edges of both stacks supported on support trays 64, 80, respectively.

It will further be appreciated that the spacing assemblies 200, 210 determine the lower most position of the pivot shaft assembly 96 shown in FIGS. 6 and 7, including the idler roller 94 and the stripper bracket 120. In this regard, the spacing assemblies 200, 210 include a stripper support or spacing surface 252. As may best be seen in FIG. 8, a rod 300 is rotatably mounted in the upper housing portion 36. To couple the stripper support surface 252 to the stripper bracket rear arm 124 of the pivot shaft assembly 96, positioning arms 302, 304 are secured to the rotatably mounted rod 300. Thus, as the front positioning arm 302 pivots, the rear positioning arm 304 likewise pivots through the same arc. Cam followers 306, 308 are provided at the distal ends of the positioning arms 302, 304 to ensure that smooth contact occurs between the arms 302, 304 and the components which they engage. It will be appreciated by those skilled in the art that, in use, the cam follower 306 at the distal end of the front positioning arm 302 is disposed on the stripper support surface 252 via gravity, which likewise determines the position of the cam follower 308 at the distal end of the other positioning arm 304.

The engagement surface 130 of the stripper bracket rear arm 126 extends through an opening in the housing to rest on the cam follower 308 disposed at the distal end of the rear positioning arm 304. In this way, the stripper support surface 252 is coupled to the pivot shaft assembly 96 to determine the position of the idler roller 92 and the stripper bracket 120. While the pivot shaft assembly 96, and the idler roller, in particular, may assume an alternate, more angled pivot position, the lower most gravity position is determined by the spacing assembly stripper support surface 252. In other words, when the machine 30 is set up to insert a larger coil, the stripper support surface 252 is disposed comparatively higher within the machine to provide the optimum idler roller 94 position for spiraling a large coil into the paper stack (see w in spacing assembly 210 of FIG. 11), while the surface 252 is comparatively low within the machine when set up for spiraling a smaller coil (see x in the spacing assembly 200 of FIG. 10). It will be appreciated by those skilled in the art that a more direct or indirect coupling is possible within the spirit and scope of the invention.

The spacing assembly likewise determines the position of the two drive rollers 90, 92. As explained above, in order to adjust the relative positions of the drive rollers 90, 92, the roller plates/bearing blocks 172, 173, 176, 177, and the roller plates/bearing blocks 174, 175, 178, 179 on which the drive rollers 90, 92 are mounted, respectively, slide laterally relative to one another along drive roller slide shafts 187, 189. As may best be seen in FIGS. 10 and 11, and according to an important feature of the invention, the spacing assembly 200, 210 includes spacing surfaces or drive roller stops 254, 256. In the preferred embodiment, the spacing assembly includes concave surfaces 260, 262 is subjacent the convex edge 202 or surface 212, 214 for receiving the drive rollers 90, 92, which act as engagement surfaces. The stops 254, 256 are then disposed subjacent these concave surfaces 260, 262, spaced in from the distal end 204, 216 of the spacing assembly 200, 210. In this way, during use, bearing blocks 173, 175 slide toward one another until shafts 180, 182 abut the drive roller stops 254, 256 of the spacing assembly 200, 210 and the drive rollers 90, 92 are disposed along concave surfaces 260, 262. Thus, it is preferable that spacing assemblies supported on the outermost, stationary brackets 226, 230 to provide proper parallel spacing of the drive rollers 90, 92. The drive rollers 90, 92 preferably do not actually contact the spacing assembly 200, 210, so that the drive rollers 90, 92 are still free to rotate to drive the coil.

It will thus be appreciated by those of skill in the art that the drive roller stops 254, 256 of the spacing assemblies 200, 210 control the location of the drive rollers 90, 92 to provide optimal spacing for a given coil. As may be seen in FIGS. 10 and 11, the guide shafts 180, 182 are disposed more closely when a small book is to be bound (see y in spacing assembly 200 of FIG. 10), than when a larger book is to be bound (see z in spacing assembly 210 in FIG. 11). In other words, the spacing assemblies 200, 210 provide not only the optimal positioning of the stack of sheets, but also all three of the rollers 90, 92, 94.

During operation, the drive roller 90, 92 and the spacing assemblies 200, 210 are initially positioned as shown in FIGS. 10 or 11, while the pivot assembly 96, and the start segment 140 and, accordingly, the idler roller 94, are pivoted upward to allow access to the coil load bracket 62. At this time, the stripper bracket 120 is disposed in its lowermost gravity position as determined by the stripper support surface 252 and the engagement surface 130, as shown in FIG. 8.

While the arm 144 to which the start segment 140 is secured may be pivoted upward by any appropriate means, it is preferably pivoted upward by a rotatable arm, or the like which engages a bottom surface of the arm 144. Thus, by moving such a rotatable arm out of engagement with the arm 144, the start segment 140 and the idler roller 94 may move into position under the force of gravity, the lower most position of the idler roller 94 being determined by the stripper bracket 120.

The operator then positions the stack of sheets on one or both of the trays 64, 80 and the appropriate coil along the coil load bracket 62 (show in FIGS. 1, 4 and 5). It will be appreciated by those of skill in the art that loops of the coil extend downward through the slotted openings in the trough of the coil load bracket 62 to contact the urethane covered portions 156, 158 of the drive rollers 90, 92. The operator activates the coiling station by depressing a start button along the panel 38, and the arms 144, 100, 102 supporting the start segment 140 and the idler roller 94 then pivot downward to position the idler roller 94 parallel the drive rollers 90, 92, and the start segment 140 along the top of the coil. The drive motor then engages to rotate the drive rollers 90, 92 to spiral the coil through the stack of sheets. The weight of the start segment 140 and the idler roller 64 ensure that the coil maintains contact with the drive rollers 90, 92 to ensure advancement of the coil. As the coil moves through the openings in the paper and the trailing end of the coil passes the start segment 140, the start segment 140 drops downward due to the force of gravity. An end of coil sensor senses this drop and disengages the motor to stop the drive rollers 90, 92.

Figure 13A:
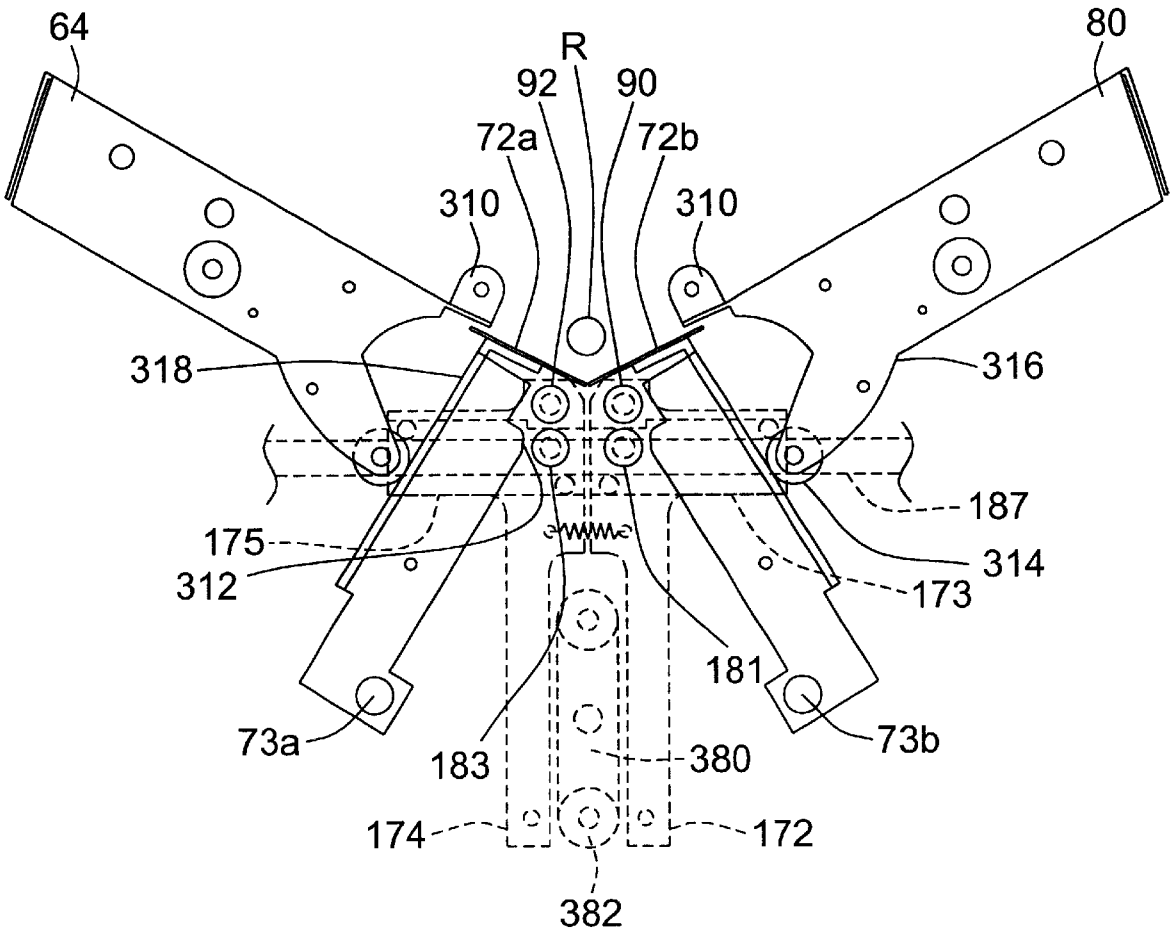
FIGS. 13A–C are schematic end views of the trays and associated components in operation to drop a bound book into the crimping station.

According to another feature of the invention the coil bound book is automatically advanced to the crimping station. In this regard, the drive rollers 90, 92 separate, and the paper support trays and combs 72*a*, 72*b* are advanced to positions which allow the coil bound book to drop into the crimping station 52 as a result of the force of gravity. While any appropriate mechanism may be provided, in order to separate the bearing blocks 173, 175, 177, 179 upon which the drive rollers 90, 92 are supported, actuation arms 380 are rotatably mounted within the machine housing 32 (see FIGS. 4, 5, 13A–C, and 16) on shaft 374. The actuation arms 380 are provided with cam followers 382 at either end and are disposed between the downwardly extending arms of the plates 170, 172, 174, 176. As the actuation arms 380 rotate, the cam followers 382 engage the plates 170, 172, 174, 176 to separate the plates, and, accordingly, the bearing blocks 173, 175, 177, 179 against the force of biasing elements or tension springs 384 disposed between pairs of plates 170, 172, 174. As may be appreciated from viewing FIGS. 13A–C, as the bearing blocks 173, 175, 177, 179 supporting the drive rollers 90, 92 are moved outwardly along the drive roller slide shafts 187, 189, the drive rollers 90, 92 separate. As the drive rollers 90, 92 move outward, an appropriate motor (not shown) pivots the spacing assemblies 200, 210 downward by rotating the spacing assembly rod 232 to lower the spacing assemblies 200, 210.

To allow the paper support trays 64, 80 to incline, the paper support trays 64, 80 are pivotably coupled via tabs 310 at the front housing to bosses 270 along the coil load bracket 62, and at the rear to bosses 272 along the rear roller guide 274, as may be seen in FIGS. 4, 5, and 13A–C. The support trays 64, 80 are coupled to the bosses 270, 272 via bearings (not visible) to ensure smooth movement. Cam followers 311 are disposed along the paper support trays 64, 80 to rest on the upper surfaces of the coil load bracket 62 and the rear roller guide 274 to define the lower most positions of the paper support trays 64, 80, while minimizing noise associated with the contact between the paper support trays 64, 80 and the surfaces of bracket 62 and guide 274. As previously explained, the pivot combs 72*a*, 72*b*, are likewise pivotably mounted such that they may rotate about points 73*a*, 73*b*.

Figure 13B:
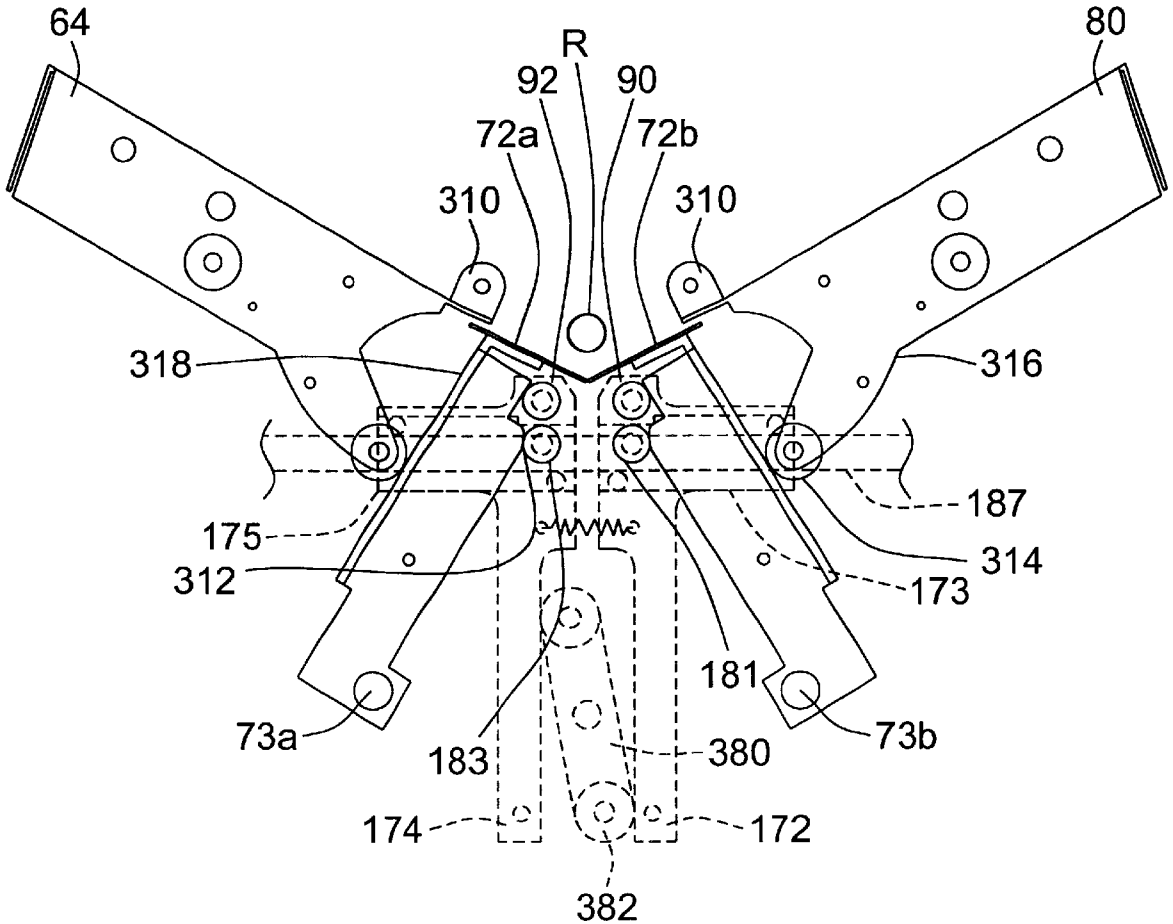
Figure 13C:
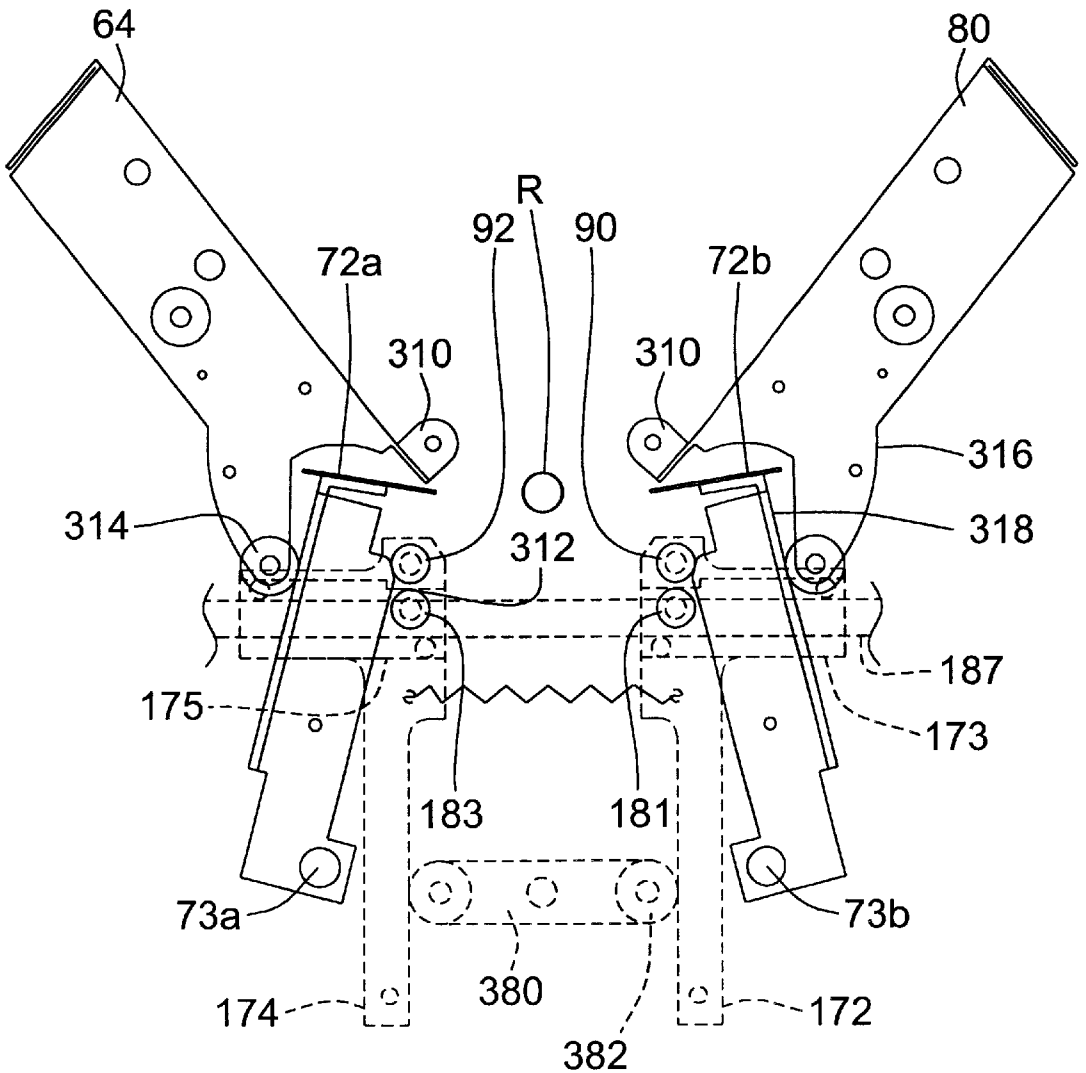

As will be appreciated from viewing FIGS. 12 and 13A–C. According to another feature of the invention, the separation of the bearing blocks 173, 175, 177, 179 causes not only the separation of drive rollers 90, 92, but the pivoting apart of the pivot combs 72*a*, 72*b* and paper support trays 64, 80, as well. For ease of viewing this movement, reference point R is provided in FIGS. 13A–C. In order to transmit the movement of the bearing blocks 173, 175, 177, 179 to the combs 72*a*, 72*b*, a lower surface 312 of each of the pivot combs 72*a*, 72*b* is disposed such that the guide shafts 181, 183 extending between the pairs of bearing blocks engage the lower surfaces 312 of the pivot combs 72*a*, 72*b* as the bearing blocks 173, 175, 177, 179 separate. Significantly, a section of the lower surface 312 is arcuate, such that as the bearing blocks 173, 175, 177, 179 separate, the guide shafts 181, 183 contact the lower surface 312 of the pivot combs 72*a*, 72*b*, as shown in FIGS. 13B. As the bearing blocks 173, 175, 177, 179 continue to separate, the lower surface 312 rides up along the guide shafts 181, 183, as shown in FIGS. 13C to pivot the pivot combs 72*a*, 72*b* upward and apart.

Figure 16:
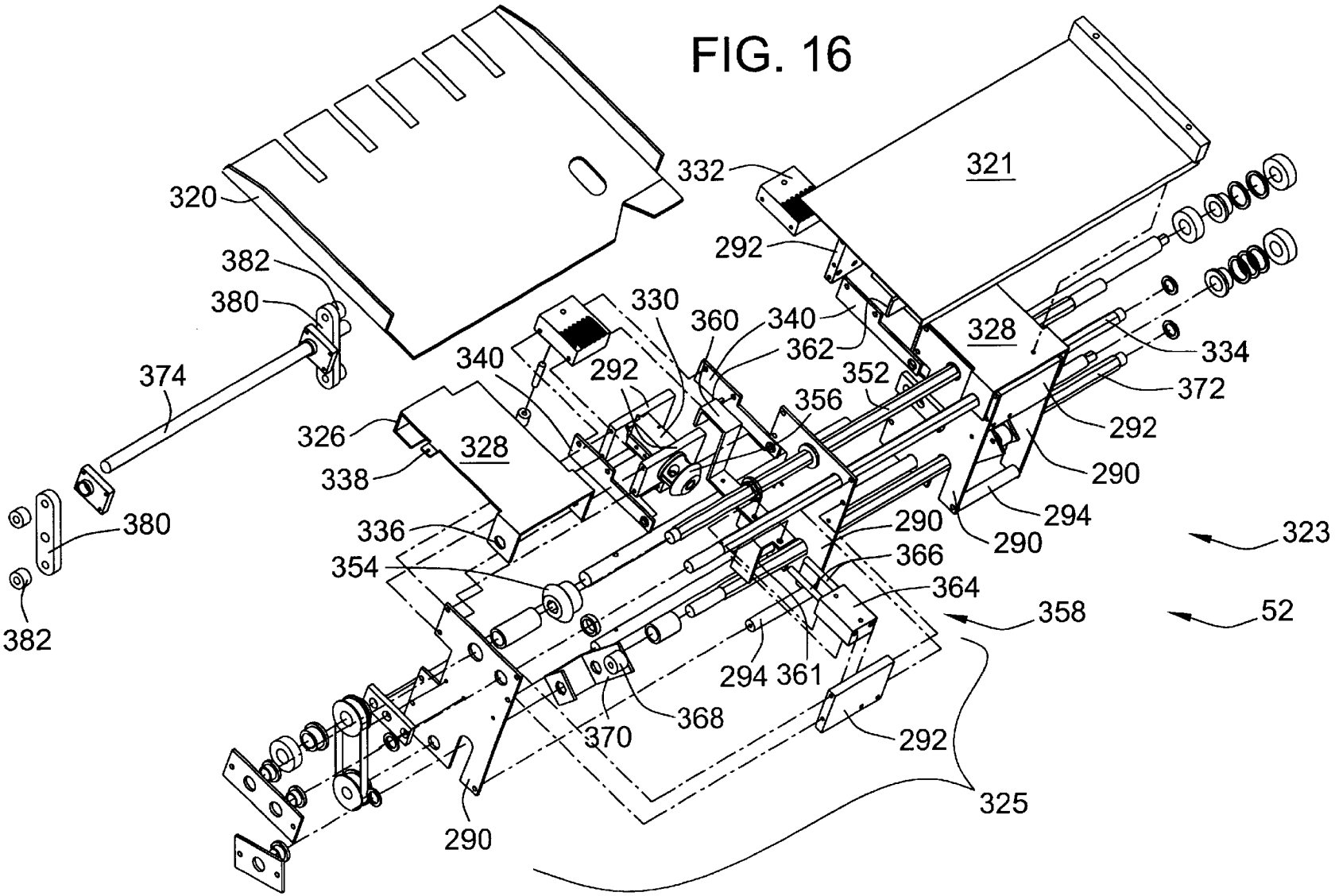
FIG. 16 is an exploded perspective view of the crimping station of FIG. 15 also illustrating the chute.

To further transmit this movement of the bearing blocks 173, 175, 177, 179 to the paper support trays 64, 80, the paper support trays 64, 80 are further provided with cam followers 314 which are disposed along arms 316 extending generally downward from the upper surface of the paper support trays 64, 80. As may be seen in FIGS. 12 and 13A–C as the pivot combs 72*a*, 72*b* pivot outward, the cam followers 314 roll along surface 318 of the pivot combs 72*a*, 72*b*, causing the paper support trays 64, 80 to pivot upward. It will thus be appreciated that as the bearing blocks 173, 175, 177, 179 to separate the drive rollers 90, 92 and guide shafts 181, 183, as the bearing blocks 173, 175, 177, 179 move linearly outward to separate the drive rollers 90, 92 and the guide shafts 181, 183, the pivot combs 72*a*, 72*b* and paper support trays 64, 80 are similarly pivoted apart. When the pivot combs 72*a*, 72*b* provide adequate clearance and the paper support trays 64, 80 reach a sufficiently inclined position that the weight of the bound book and force of gravity overcome the friction between the stack(s) of sheets supported on the paper support trays 64, 80, the book slides downward between the open components and on to a chute 320 disposed subject the coiling station 50 (see FIGS. 14A–F to automatically advance the coil bound book to the coil crimping station 52. The chute 320 is preferably pivotably disposed within the housing at an angle on the order of 45°, although the chute 320 may be disposed at the greater or lesser angle. In the preferred design, the chute 320 is secured to a pivotable shaft 374, such as is illustrated in FIG. 16.

Returning to FIGS. 4 and 5, to ensure that the book drops substantially straight downward, a drop edge guide 276 is provided. The drop edge guide assembly 276 comprises connector portion 280, here a magnet, which couples to the support tray 64, and a flag portion 282. As the book drops, the magnet 280 keeps the book from rotating as it drops. Additionally, if the flag portion 282 is disposed such that the tip is positioned between the idler roller 94 and drive roller 92, the flag portion 282 prevents a smaller coil, which rotates at a very fast rate, from spiraling out the end of the book.

After the coiled book drops downward to the crimping station 52, the support trays 64, 80 pivot back to their support positions, and the spacing assemblies 200, 210, pivot combs, and drive rollers 90, 92 return to their original positions in preparation to spiral the next coil into the next stack of sheets.

Figure 17:
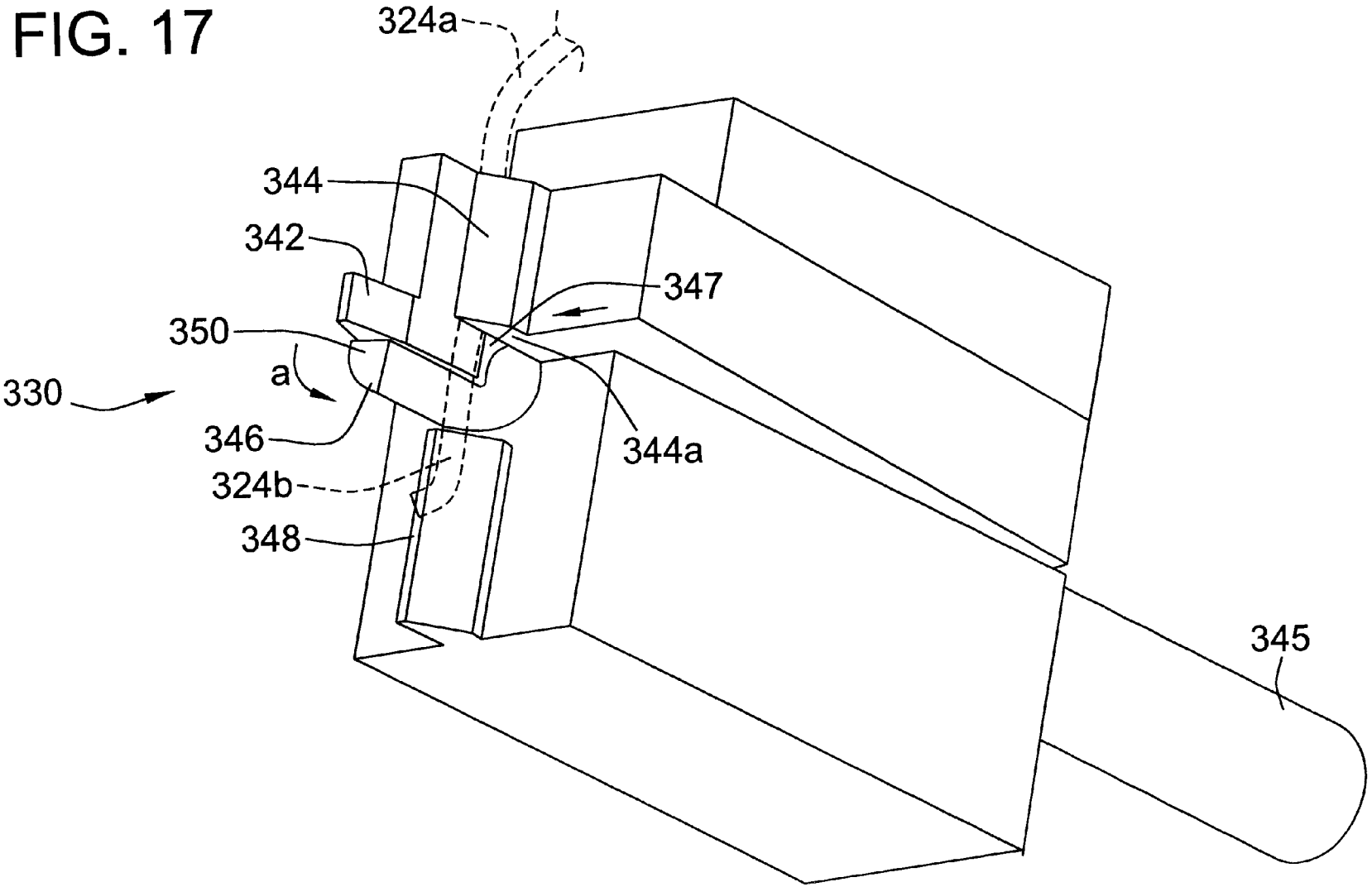
FIG. 17 is a perspective view of the crimping subassembly of FIGS. 14–16.

Turning now to FIGS. 14A–F, there are shown progressive views of a stack of sheets 322 with a coil 324 advanced therethrough disposed at the crimping station 52 before, during and after completion of the crimping process. Elements of the crimping station 52 are further shown in assembled and in exploded form in FIGS. 15–17 for clarity.

The basic framework of the crimping station is supplied by a front and a rear crimper tower 323, 325 with a crimping station deck plate 321 disposed along their upper surfaces, bridging the distance therebetween. In order to accommodate different lengths of books, the rear tower 325 may be slide laterally within the crimping station 52 to facilitate the crimping the end of a coil in different lengths of books. Each tower 323, 325 preferably comprises two pairs of side plates 290 spaced apart by spacing plates 292 and rods 294. Substantially all of the components of the crimping station 52 are coupled to the side plates 290 or the spacing plates 292 and rods 294. It will be appreciated that the structure and operation of the towers 323, 325 and the components contained therein are substantially the same.

As the coiled stack of sheets 322/324 advances into the crimping station (see FIG. 14A), the sliding movement of the coiled stack of sheets 322/324 is arrested as the coil 324 comes into contact with the stop 326 of the clamp bracket 328. The actual crimping operation is performed by the crimper subassembly 330 with the coil 324 positioned along the crimp guide block 332, as will be explained below. In order to properly position the coil 324 along the crimp guide block 332 and the crimper subassembly 330, the clamp bracket 328 is pivotably coupled to the crimper tower 323, 325 such that the clamp bracket 328 may be pivoted upward to allow the coil 324 to advance due to the weight of gravity (see FIG. 14B). Once the coil 324 is in the proper position, the clamp bracket 328 is rotated back downward to the position illustrated in FIG. 14C such that the weight of the clamp bracket 328 exerts a downward force on the coil 324 to hold it firmly in position.

To provide pivoting movement to the clamp bracket 328, the clamp bracket 328 has openings 336 which closely receive a hexagonal or otherwise splined shaft 334. In this way, while the clamp bracket 328 may still slide along the splined rod 334 during repositioning of the tower 325, rotation of the clamp bracket splined shaft 334 causes a pivoting movement of the clamp bracket 328. To facilitate smooth movement of the clamp bracket 328, a tension spring (not shown) may be coupled to a tab 338 on the clamp bracket 328 and the tower 323, 325.

Figure 14A:
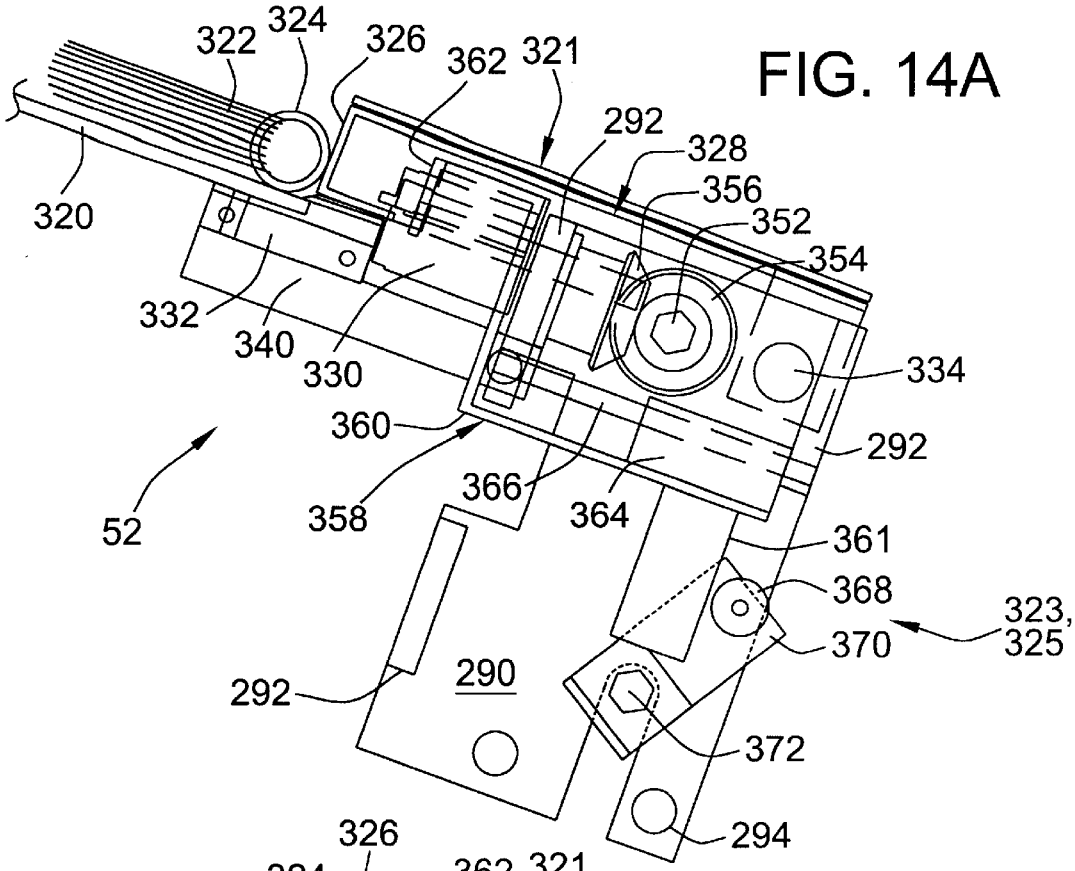
FIGS. 14A–F are rear end elevational views of elements of the crimping station one of the side plates removed at various positions during the crimping process.
Figure 14B:
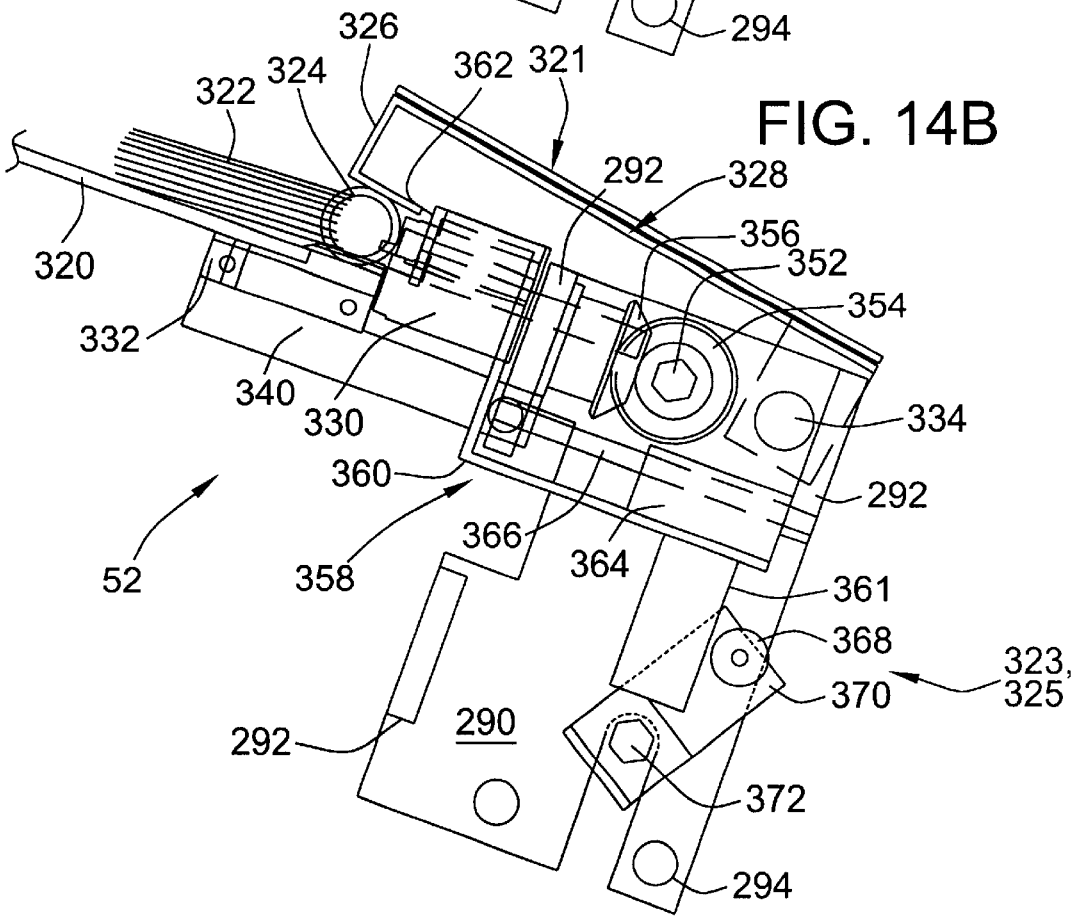
Figure 14C:
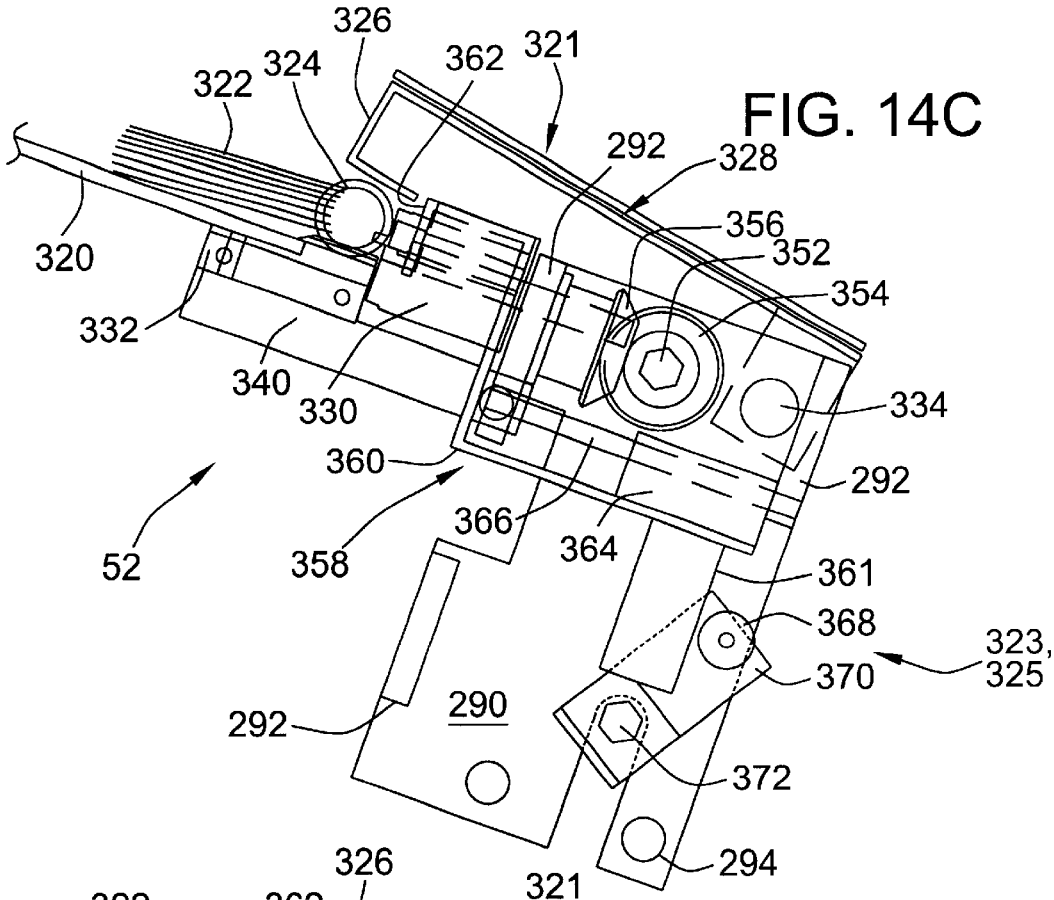
Figure 15:
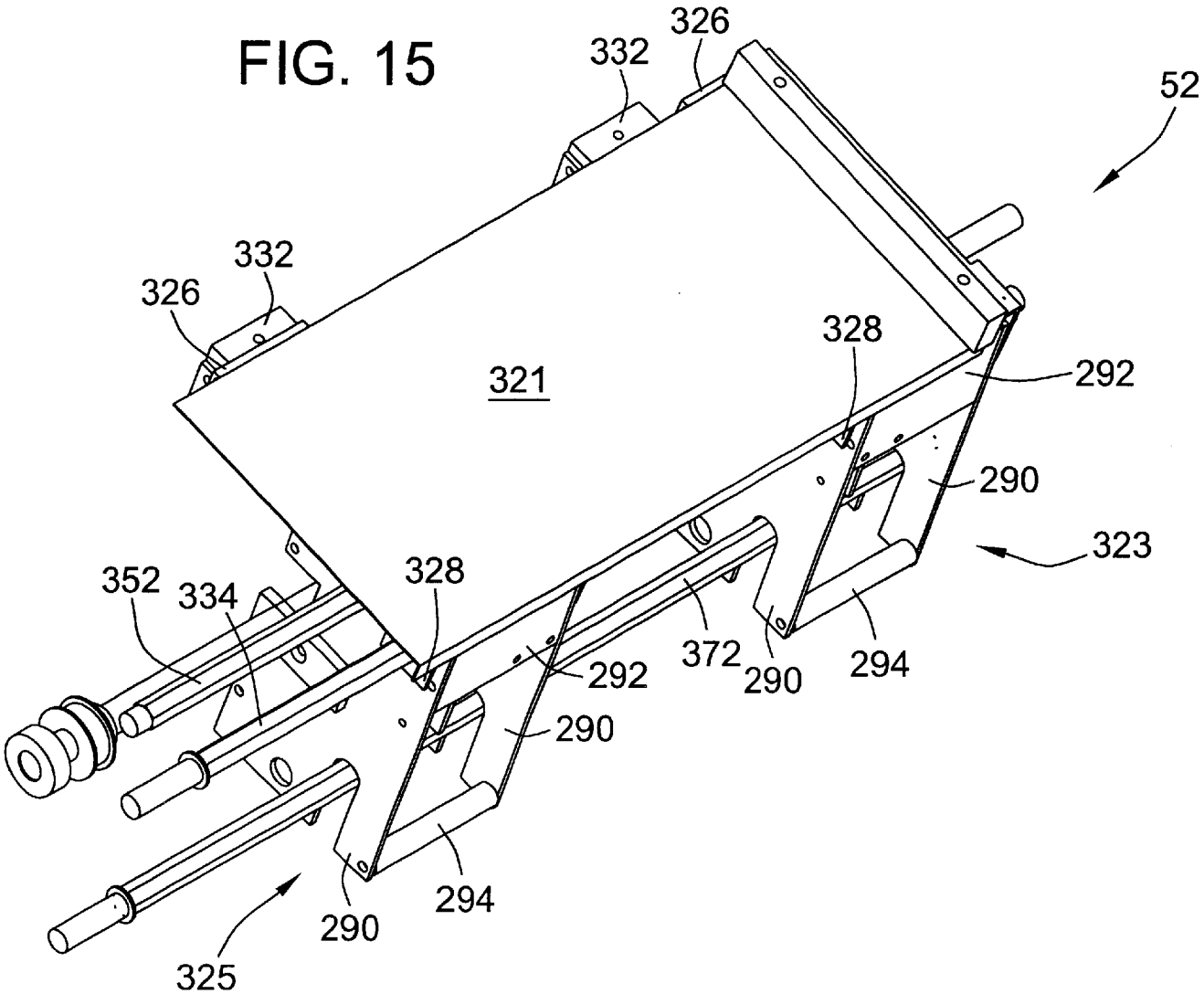
FIG. 15 is a perspective view of a crimping station subassembly of FIGS. 1 & 14A–F constructed in accordance with teachings of the invention.

As may be seen in FIGS. 14B and 14C, when properly positioned along the crimp guide block 332, the lower surfaces of the coil 324 are positioned within channels in the upper surface of the crimp guide block 332. It will be appreciated that these channels assist in maintaining the coil 324 steady before and during the crimping process and in properly positioning the coil for the crimping process. The crimp guide block 332 is coupled to the tower 323, 325 by means of plates 340 disposed along opposite sides thereof The crimping operation itself is performed by the crimper subassembly 330, which may be seen most clearly in FIG. 17. While the crimping operation may be performed by any appropriate crimping assembly, in the preferred embodiment, the crimper subassembly includes jaws 342, 344 which clamp a loop 324*a* of the coil 324, a rotatable actuator 346, and a blade 348. The pair of jaws include a stationary jaw 342 and a cam-operated, moveable jaw 344 that are spring biased toward one another. The rotatable actuator 346 is basically a cylindrical shaft 345 that includes a cam 347 and an outwardly extending arm 350 which engages the loop 324*a* of the coil 324 it rotates. The cam 347 acts upon an inside surface of the moveable jaw 344 to hold the jaws 342, 344 open an initial position illustrated, the cam 347 rotating out of engagement with the moveable jaw 344 as the actuator 346 rotates (see arrow a) engages the coil loop 324*a* for cutting and bending. In this way, the spring-biased jaws 342, 344 clamp the loop 324*a* of the coil 324 as the actuator 346 rotates (see arrow a).

In order to rotate the actuator 346, a hexagonal or otherwise splined shaft 352 is provided which extends through the side plates 290. As with the clamp bracket splined shaft 334, the splined nature of the shaft 352 allows transmission of the rotation of the shaft 352 even when the tower 325 is repositioned to accommodate a different length of book. Rotation of the shaft 352 is transmitted to the rotatable actuator 346 by pair of bevel gears 354, 356 secured to the rotatable actuator 346 and disposed about the shaft 352, respectively.

It will be appreciated that as the actuator 346 rotates, the outwardly extending arm 350 presses the coil loop 324*a* into engagement with the blade 348 to cut off the protruding end 324*b* of the coil 324. As the actuator 346 continues to rotate, the arm 350 continues to bend the now cut end of the coil 324 about the end 344*a* of the jaw 344. In this way, the actuator 346 causes a crimping of the coil 324 end which prevents the coil 324 from rotating out of the perforated stack of sheets 322. It will be appreciated that the end 344*b* of the coil that has been cut off drops within the machine 30 to the disposal chute 44 (see FIGS. 1 and 2) for disposal.

Figure 14D:
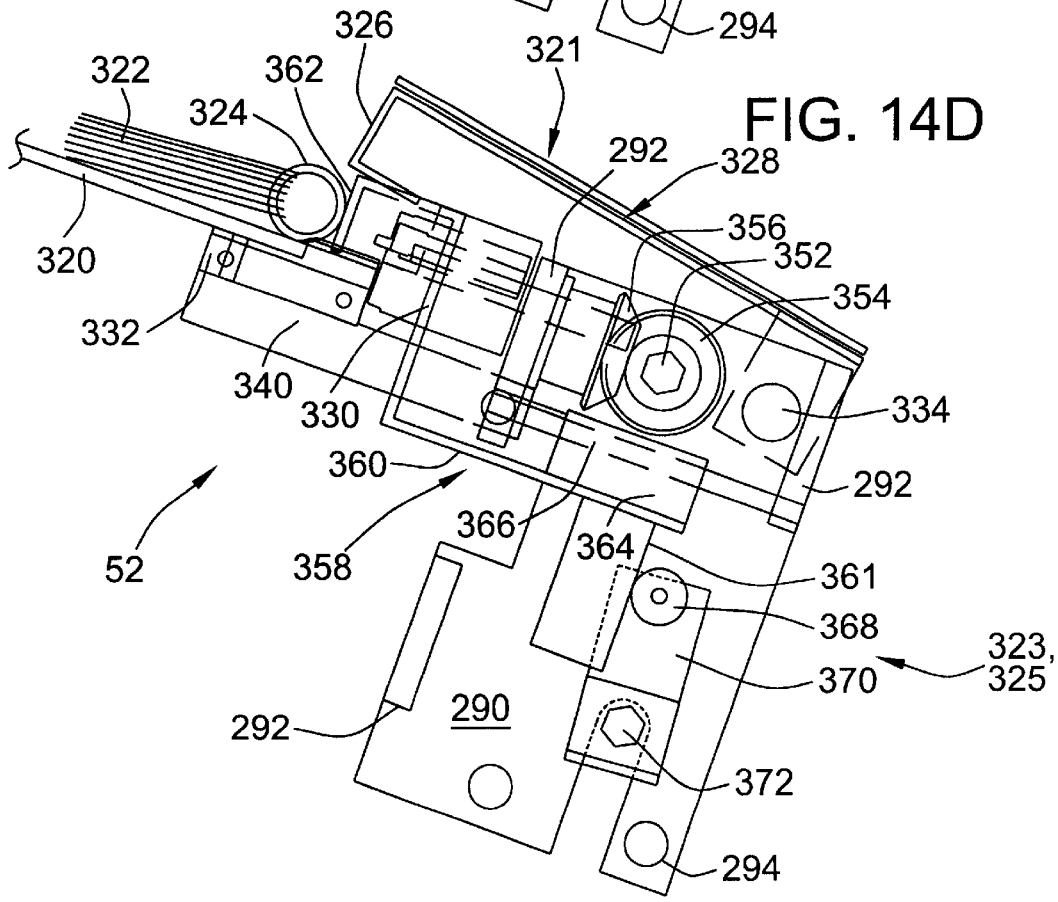

In order to eject the bound and crimped book 322/324 from the crimping station 52, an ejector assembly 358 is provided. The ejector assembly 358 includes a bracket 360 which includes an actuating surface 361 and a surface 362 that is disposed to engage an edge of the coil 324 to eject the bound and crimped book from the crimper subassembly 330. The bracket 360 is slidably disposed by way of a guide block 364 along a pair of guide rods 366 mounted in the 323, 325. To eject the book, the bracket 360 and guide block 364 slides forward along the guide rods 366 to engage the coil 324 as shown in FIG. 14D.

The translational movement of the bracket 360 is provided by way of a cam follower 368 mounted to a drive bracket 370 pivotably coupled to a hexagonal or otherwise splined shaft 372. As the splined shaft 372 rotates, the drive bracket 370 rotates the cam follower 368 into contact with the actuation surface 361 of the bracket 360 to advance the bracket 360 and guide block 364 along the guide rods 366 to eject the finished book. As with the clamp bracket splined shaft 334 and the crimping subassembly splined shaft 352, the drive bracket 370 is slidable along the drive bracket splined shaft 372, allowing the tower 323, 325 to be slid along the shaft 372 the crimping station 52 to be set up for various lengths of books.

Figure 14E:
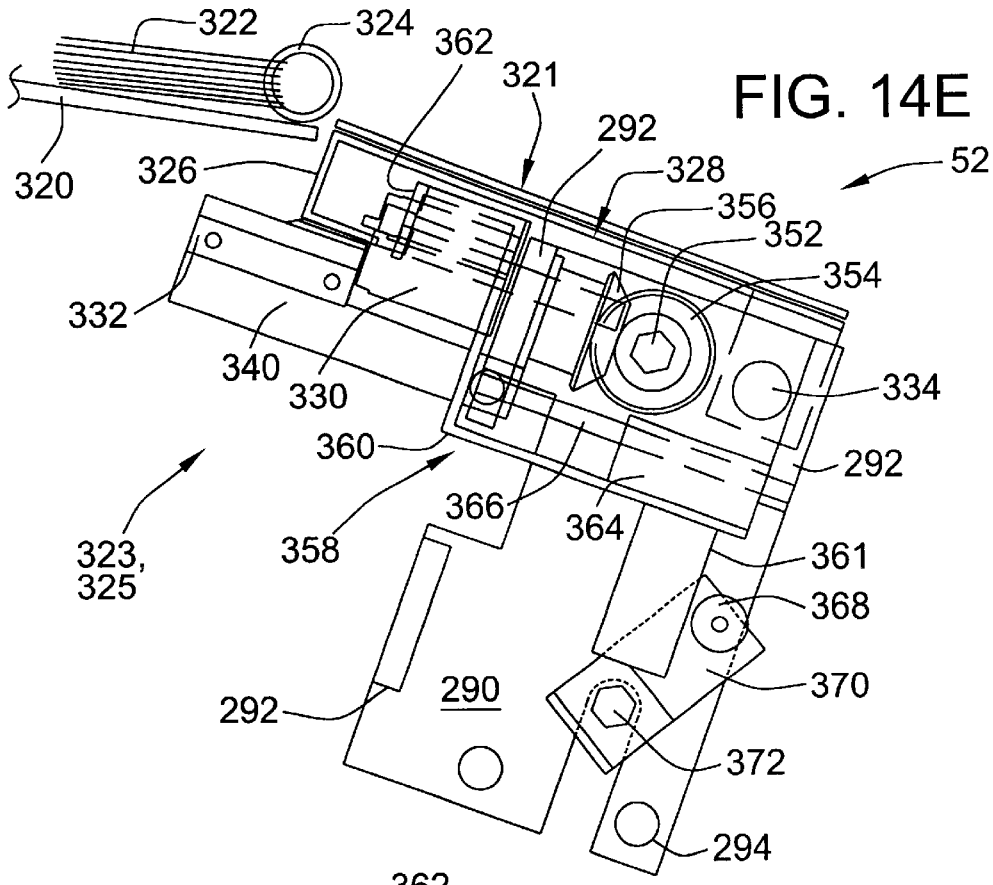
Figure 14F:
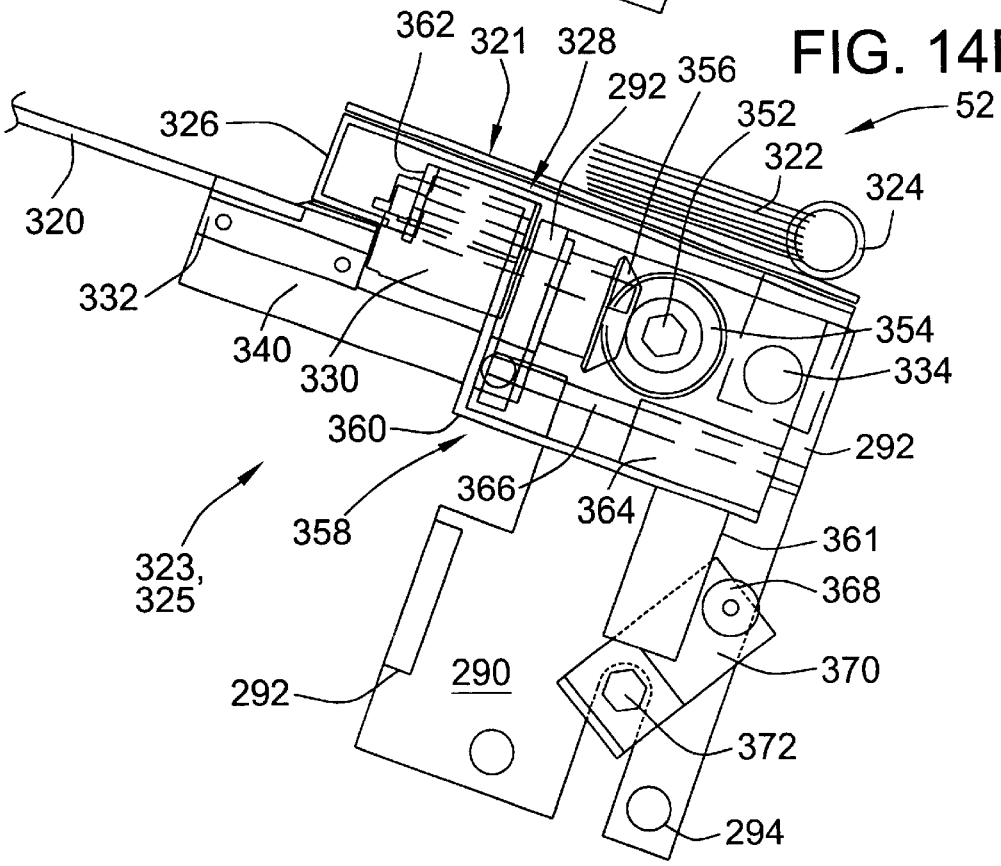

Once the crimped book is ejected from the crimping subassembly 330, the clamp bracket 328 pivots downward due to the force of gravity and the spring bias. The ejector 360 then retracts, returning to its original position while the chute 320 pivots upward about shaft 374 (see FIG. 15), as shown in FIG. 14E. The bound book is then free to slide along the crimping station deck plate 321 and into the output tray 54. An actuated door is preferably provided as a safety feature between the deck plate 321 and the output tray 54. In summary, the invention provides an efficient and versatile coil binding machine that may be readily utilized in an office atmosphere. The machine not only coils a preformed coil into a stack of sheets, but crimps the ends of the coil to create a book with a professional appearance. Further, the machine may be readily set up to assemble books of various thickness by merely changing the spacing assemblies, readily assessable from a door through the housing. Inasmuch as the machine automatically performs the coiling process, advances the book to the crimping station, crimps the coil ends, and ejects the book from the machine, a large number of books may be assembled in relatively rapid order.

I claim:

1. An automated machine for spirally binding coils of various curvatures into a stack of sheets having prepunched holes along a side edge thereof, said machine comprising, in combination:

a support surface adapted to support the stack of sheets and having an edge adapted to be positioned substantially adjacent the prepunched holes;

a rotatable drive roller for engaging said coil and spirally feeding said coil lengthwise through said prepunched holes;

a drive system for rotating said drive roller;

at least one coil guiding assembly comprising an engagement surface and an elongated coil guiding surface mounted substantially parallel to the edge of the support surface, said elongated coil guiding surface being mounted for movement between a first position wherein said elongated coil guiding surface is disposed to not engage said coil as it spirally feeds lengthwise through said prepunched holes and a second position wherein said elongated coil guiding surface is disposed to engage said coil as it spirally feeds lengthwise through said prepunched holes;

a plurality of spacing assemblies for said various curvatures of coils, each said spacing assembly having at least one spacing surface, and at least one mounting structure for mounting at least one of said spacing assemblies such that in moving the elongated coil guiding surface between the first and second positions, an abutment of the engagement surface with the spacing surface determines said second position of the elongated coil guiding surface for a given curvature of coil.

2. The automated machine of claim 1 wherein the elongated coil guiding surface is the rotatable drive roller.

3. The automated machine of claim 1 wherein the elongated coil guiding surface is an idler roller.

4. The automated machine of claim 1 wherein the elongated coil guiding surface is a bracket.

5. The automated machine of claim 1 comprising at least two coil guiding assemblies and at least a portion of said spacing assemblies comprising at least two spacing surfaces, the second positions of the elongated guiding surfaces of said coil guiding assemblies being determined by the abutment of the engagement surfaces of said at least two guiding assemblies with the at least two spacing surfaces.

6. The automated machine of claim 5 wherein one of the elongated guiding surfaces comprises the rotatable drive roller.

7. The automated machine of claim 6 wherein another of elongated guiding surfaces comprises a second drive roller.

8. The automated machine of claim 6 further comprising a chute having a first and a second end, and wherein the at least two elongated guiding surfaces are disposed subjacent the support surface and wherein the two elongated guiding surfaces are disposed a greater distance from one another in the first position than in the second position, said first end of the chute is disposed subjacent the at least two elongated guiding surfaces, such that a stack of sheets having the coil advanced through the prepunched holes advances down the chute due to the force of gravity when the at least two elongated guiding surfaces move between the second position and the first position.

9. The automated machine of claim 5 wherein each said spacing assembly further comprises at least one shaping surface which approximates the given curvature of coil, and said at least one mounting structure disposes said shaping surface substantially perpendicular to the edge of the support surface such that the side edge of the stack of sheets conforms to the shape of the shaping surface to approximate the shape of the given curvature of coil.

10. The automated machine of claim 5 wherein said at least two elongated guiding surfaces have opposite ends and each coil guiding assembly includes mounting elements disposed at said opposite ends.

11. The automated machine of claim 10 wherein said coil guiding assemblies includes mounting blocks in which opposite ends of said elongated guiding surfaces are disposed, said coil guiding assemblies further including elongated elements disposed substantially parallel said elongated coil guiding surfaces, said elongated elements comprising said engagement surfaces.

12. The automated machine of claim 1 comprising at least three coil guiding assemblies and at least a portion of said spacing assemblies comprising at least three spacing surfaces, the second positions of the elongated guiding surfaces of said coil guiding assemblies being determined by the abutment of the engagement surfaces of said at least three guiding assemblies with the at least three spacing surfaces.

13. The automated machine of claim 12 wherein one of said elongated guiding surfaces comprises said rotatable drive roller.

14. The automated machine of claim 13 wherein at least one of said elongated guiding surfaces comprises a second rotatable drive roller.

15. The automated machine of claim 12 wherein each said spacing assembly further comprises at least one shaping surface which approximates the given curvature of coil, and said at least one mounting structure disposes said shaping surface substantially perpendicular to the edge of the support surface such that the side edge of the stack of sheets conforms to the shape of the shaping surface to approximate the shape of the given curvature of coil.

16. The automated machine of claim 1 wherein each said spacing assembly further comprises at least one shaping surface which approximates the given curvature of coil, and said at least one mounting structure disposes said shaping surface substantially perpendicular to the edge of the support surface such that the side edge of the stack of sheets conforms to the shape of the shaping surface to approximate the shape of the given curvature of coil.

17. The automated machine of claim 1 further comprising a stripper bracket pivotably mounted substantially parallel said edge above a plane containing said support surface and being moveable between an upper position and a lower position, said lower position being determined by gravity as the engagement surface abuts the spacing surface.

18. The automated machine of claim 1 further comprising a guiding surface driving motor, said elongated guiding surface being advanced to said second position by said guiding surface driving motor.

19. The automated machine of claim 1 further comprising a second support surface adapted to support a second stack of sheets and having a second support surface edge, said second support surface edge being positioned substantially parallel and spaced away from said support surface whereby said coil may be spirally advanced through the prepunched holes in both stacks of sheets simultaneously.

20. The automated machine of claim 19 wherein each said spacing assembly further comprises two shaping surfaces which approximate the given curvature of coil, and said at least one mounting structure disposes said shaping surfaces substantially perpendicular to the edges of the support surfaces such that the side edges of the stack of sheets conform to the shape of the shaping surfaces to approximate the shape of the given curvature of coil.

21. The automated machine of claim 1 comprising at least two mounting structures for mounting at least two of said spacing assemblies, the engagement surface of said at least one coil guiding assembly abutting said spacing surface of at least one of said at least two said spacing assemblies when the elongated coil guide is in said second position.

22. The automated machine of claim 21 further comprising a shaft extending substantially parallel to the edge, said mounting structures being coupled to said shaft, and wherein at least one of said mounting structures is laterally adjustable along said shaft.

23. The automated machine of claim 1 further comprising an angled chute having first and second ends, the first end of the chute being disposed subjacent edge of the support surface, such that a stack of sheets having the coil advanced through the prepunched holes feeds from the support surface down the chute due to the force of gravity.

24. The automated machine of claim 1 further comprising an angled chute having first and second ends, the first end of the chute being disposed subjacent the edge of the support surface, said automated machine further comprising a crimping station disposed subjacent the second end of the chute, such that a stack of sheets having the coil advanced through the prepunched holes feeds from the support surface down the chute to be positioned in the crimping station due to the force of gravity.

25. The automated machine of claim 24 wherein the support surface is pivotably mounted such that pivoting the support surface toward a vertical position advances the stack of sheets having the coil fed through the prepunched holes from the support surface to the chute.

26. An automated machine for spirally binding coils into stacks of sheets having prepunched holes along a side edge thereof, said machine comprising, in combination:

a drive system for driving a coil through said prepunched holes;

first and second support surfaces adapted to each support a stack of sheets and each having an edge adapted to be positioned substantially adjacent the prepunched holes, said support surfaces being positioned at an angle to one another with said edges substantially parallel and spaced away from one another, whereby said coil may be spirally advanced through the prepunched holes in both stacks of sheets simultaneously.

27. The automated machine of claim 26 further comprising an angled chute having first and second ends, the first end of the chute being disposed subjacent the edges of said support surfaces, said automated machine further comprising a crimping station disposed subjacent the second end of the chute, such that a stack of sheets having the coil fed through the prepunched holes feeds from the support surfaces down the chute to be positioned in the crimping station due to the force of gravity.

28. The automated machine of claim 27 wherein at least one of the support surfaces is pivotably mounted such that pivoting the at least one of the support surfaces toward a vertical position advances the stack of sheets having the coil fed through the prepunched holes from the support surface to the chute.

29. An automated machine for spirally binding coils of various curvatures into a stack of sheets having prepunched holes along a side edge thereof, said machine comprising, in combination:

a support surface adapted to support the stack of sheets and having an edge adapted to be positioned substantially adjacent the prepunched holes;

a drive system for spirally feeding said coil lengthwise through said prepunched holes;

a plurality of spacing assemblies for said various diameters of coils, each said spacing assembly having at least one shaping surface which approximates the given curvature of coil, and at least one mounting structure for mounting at least one of said spacing assemblies with said shaping surface disposed substantially perpendicular to the edge of the support surface such that the side edge of the stack of sheets conforms to the shape of the shaping surface to approximate the shape of the given curvature of coil, said at least one mounting structure comprising at least one locating structure and a thumb screw having an enlarged head and a threaded rod, the at least one of said spacing assemblies including a slot for receiving the threaded rod and at least one surface mating to the at least one locating structure said at least one of said spacing assemblies being readily removable from and readily mountable to said at least one mounting structure by disposal of the at least one mating surface adjacent the at least one locating structure, the slot adjacent the locating the threaded rod, and the tightening of the thumbscrew, and whereby said spacing assembly mounted to said mounting structure may be readily removed from said mounting structure by loosening the thumbscrew, and an alternate spacing assembly of said plurality of spacing assemblies subsequently mounted to said mounting structure to rapidly modify said machine to spirally bind a coil of a different curvature into a supported stack of sheets.

30. An automated machine for spirally binding coils of various curvatures into a stack of sheets having prepunched holes along a side edge thereof, said machine comprising, in combination:

a first support surface adapted to support the stack of sheets and having a first support surface edge adapted to be positioned substantially adjacent the prepunched holes;

a second support surface adapted to support a second stack of sheets and having a second support surface edge, said second support surface edge being positioned substantially parallel and spaced away from said first support surface a drive system for spirally feeding said coil lengthwise through said prepunched holes, said drive system spirally advancing said coil through the prepunched holes in both stacks of sheets simultaneously;

a plurality of spacing assemblies for said various diameters of coils, each said spacing assembly having at least one shaping surface which approximates the given curvature of coil, and at least one mounting structure for mounting at least one of said spacing assemblies with said shaping surface disposed substantially perpendicular to the edge of the support surface such that the side edge of the stack of sheets conforms to the shape of the shaping surface to approximate the shape of the given curvature of coil.

31. The automated machine of claim 30 wherein each said spacing assembly further comprises two shaping surfaces which approximate the given curvature of coil, and said at least one mounting structure disposes said shaping surfaces substantially perpendicular to the edges of the support surfaces such that the side edges of the stack of sheets conform to the shape of the shaping surfaces to approximate the shape of the given curvature of coil.

32. An automated machine for spirally binding coils into stacks of sheets having prepunched holes along a side edge thereof, said machine comprising, in combination:

a coiling station having a drive system for driving a coil through said prepunched holes;

a support surface adapted to each support a stack of sheets and each having an edge adapted to be positioned substantially adjacent the prepunched holes, an angled chute having first and second ends, the first end of the chute being disposed subjacent the edge of the support surface, a crimping station disposed subjacent the second end of the chute such that a stack of sheets having the coil fed through the prepunched holes feeds from the support surface down the chute to be positioned in the crimping station due to the force of gravity, said crimping station comprising at least one crimper for crimping an end of the coil, a clamp bracket, said clamp bracket being disposed to place a force on the coil during crimping, an ejector for ejecting the coil from the crimper, and an exit chute for receiving the coiled stack of sheets after crimping.

33. The automated machine of claim 32 further comprising a crimping guide block, the coil being disposed between the clamp bracket and the crimping guide block during crimping.

34. The automated machine of claim 32 further comprising a deck plate for supporting the stack of sheets during the crimping processing, said deck plate being pivotably mounted and disposed to pivot to a position adjacent the exit chute such that the deck plate may pivot to the position adjacent the exit chute whereby the coiled stack of sheets may advance to the exit chute due to the force of gravity.

35. An automated machine for spirally binding coils of various curvatures into a stack of sheets having prepunched holes along a side edge thereof, said machine comprising, in combination:

a support surface adapted to support the stack of sheets and having an edge adapted to be positioned substantially adjacent the prepunched holes;

a plurality of spacing assemblies for said various diameters of coils, each said spacing assembly having at least one shaping surface which approximates the given curvature of coil, the plurality of spacing assemblies flier comprising at least one spacing surface, a drive system for spirally feeding said coil lengthwise through said prepunched holes, the drive system comprising a plurality of coil guiding surfaces and at least one engagement surface, a location of at least one of the plurality of coil guiding surfaces being determined by abutment of the engagement surface with said spacing surface; and at least one mounting structure for mounting at least one of said spacing assemblies with said shaping surface disposed substantially perpendicular to the edge of the support surface such that the side edge of the stack of sheets conforms to the shape of the shaping surface to approximate the shape of the given curvature of coil, said at least one of said spacing assemblies being readily removable from and readily mountable to said at least one mounting structure whereby said spacing assembly mounted to said mounting structure may be readily removed from said mounting structure and an alternate spacing assembly of said plurality of spacing assemblies subsequently mounted to said mounting structure to rapidly modify said machine to spirally bind a coil of a different curvature into a supported stack of sheets.

36. The automated machine of claim 35 wherein the at least one of the plurality of coil guiding surfaces is a roller.

* * * * *